US012392523B2

(12) United States Patent
Hughes

(10) Patent No.: US 12,392,523 B2
(45) Date of Patent: Aug. 19, 2025

(54) SYSTEMS AND METHODS FOR OPERATING A CLIMATE CONTROL SYSTEM ON A MICROGRID

(71) Applicant: Trane International Inc., Davidson, NC (US)

(72) Inventor: John Hughes, Flint, TX (US)

(73) Assignee: Trane International Inc., Davidson, NC (US)

( * ) Notice: Subject to any disclaimer, the term of this patent is extended or adjusted under 35 U.S.C. 154(b) by 195 days.

(21) Appl. No.: 18/345,184

(22) Filed: Jun. 30, 2023

(65) Prior Publication Data

US 2025/0003625 A1 Jan. 2, 2025

(51) Int. Cl.
*F24F 11/88* (2018.01)

(52) U.S. Cl.
CPC ..... *F24F 11/88* (2018.01)

(58) Field of Classification Search
CPC ..... F24F 2140/50; F24F 2140/60
See application file for complete search history.

(56) References Cited

U.S. PATENT DOCUMENTS

| | | | |
|---|---|---|---|
| 5,036,449 | A | 7/1991 | Dhyanchand et al. |
| 7,741,818 | B2 | 6/2010 | Agari |
| 7,956,586 | B2 | 6/2011 | Nagai et al. |
| 8,193,660 | B2 | 6/2012 | Rockenfeller et al. |
| 9,071,078 | B2 | 6/2015 | Rockenfeller et al. |
| 9,310,401 | B2 | 4/2016 | Tsao et al. |
| 9,417,615 | B2 | 8/2016 | Vanthournout |
| 9,898,018 | B2 | 2/2018 | Zubieta et al. |
| 9,921,595 | B2 | 3/2018 | Nakamoto |
| 9,985,528 | B2 | 5/2018 | Romeo |
| 10,218,265 | B2 | 2/2019 | He et al. |
| 11,101,658 | B2 | 8/2021 | McDonnell |
| 11,157,031 | B2 | 10/2021 | Wong et al. |
| 2011/0276194 | A1* | 11/2011 | Emalfarb ..... B60L 53/66 700/297 |
| 2014/0163761 | A1* | 6/2014 | Kuhns ..... H02J 4/00 700/295 |
| 2022/0320859 | A1 | 10/2022 | Yuan et al. |

FOREIGN PATENT DOCUMENTS

| | | | |
|---|---|---|---|
| AU | 2017200652 | A1 | 8/2018 |
| IN | 201811043809 | A | 8/2020 |
| JP | 7155992 | B2 * | 10/2022 |

* cited by examiner

*Primary Examiner* — Emmanuel E Duke
(74) *Attorney, Agent, or Firm* — Womble Bond Dickinson (US) LLP

(57) ABSTRACT

Examples of the present disclosure relate to systems and methods for operating a climate control system on a microgrid utilizing renewable sources of power including solar panels and wind turbines. In general, this disclosure focuses on utilizing a range of stepped or discrete demand responses for the climate control system to adjust power consumption levels in response to variable levels of power input associated with renewable power sources attached to the microgrid. These stepped or discrete demand responses of the climate control system may allow the microgrid to react to linear, continuous, or non-discrete fluctuations in the input power while reducing the likelihood of damage to the climate control system. Some examples may also allow the climate control system to more consistently maintain comfort settings of conditioned spaces. Some examples utilize a direct current (DC) microgrid and climate control system.

20 Claims, 6 Drawing Sheets

SYSTEMS AND METHODS FOR OPERATING A CLIMATE CONTROL SYSTEM ON A MICROGRID

TECHNOLOGICAL FIELD

The present disclosure relates generally to systems and methods for determining operating parameters for a climate control system according to power availability of various associated power sources.

BACKGROUND

Various climate control systems exist, and several of these systems are able to provide both heating and cooling. These systems use refrigerant circuits to transport thermal energy between components of the system. Each of these designs offer various advantages, and typically provide for conditioning over a given temperature range. A common form of these systems, often referred to as a heat pump, uses a reversible refrigerant circuit that moves thermal energy between two or more heat exchangers to provide heating and/or cooling as desired.

Microgrids are localized power systems that can be used to provide power to buildings or interconnected complexes. Such systems often have boundaries that define them from the national power grid and adjacent microgrids. Buildings that use renewable energy may utilize a microgrid to supply power to various building systems. Utilizing renewable energy to operate a climate control system may be problematic for a number of reasons. Weather phenomenon and technical failures associated with renewable energy may result in input power fluctuations, e.g., continuous decreases, for the climate control system. For example, power provided by solar panels may be continuously reduced or completely interrupted by cloud coverage, storms, snow, or other weather phenomenon.

Further, solar panels are most effective when directly facing the sun, so energy captured by static solar panels will necessarily vary throughout the day as the sun moves across the sky. Additionally, during insufficient wind conditions, a wind turbine may be unable to produce electrical power due to an insufficient amount of motive power from the wind, or during excessive wind conditions the wind turbine may be configured to cease operation to prevent damage. Moreover, power may be reduced or interrupted due to worn or broken components, for example a worn bearing on a wind turbine or a shattered cell on a solar panel.

Further, existing renewable energy based microgrids typically convert direct current to alternating current to power existing climate control systems. These conversion processes provide a loss in efficiency and fail to compensate for inconsistent renewable power generation. Other, more complex, microgrids have automated backup power generators that are utilized in certain instances. These complex systems, however, are often overly expensive and require additional fuels and generator storage that is not practicable, particularly not to individual homeowners.

As a result, there exists a need to operate climate control systems with renewable energy microgrids in a practical and useful way.

BRIEF SUMMARY

The present disclosure includes, without limitation, the following examples.

Some example implementations include a climate control system coupled to a microgrid power unit and configured to provide a stepped demand response, the climate control system comprising: a plurality of components, wherein at least one component is powered from a power supply provided by the microgrid power unit; and a controller operably coupled to the at least one component, the controller including a memory configured to store computer executable components and a processor configured to execute computer executable components to cause the controller to at least: receive a first voltage indication from the microgrid power unit, the microgrid power unit including a renewable power source; determine a second indication, the second indication indicative of a condition of at least one of the following the climate control system, the microgrid power unit, and a utility power grid; determine an adjusted operating parameter for the at least one component of the climate control system based on the first voltage indication and the second indication, wherein determining the adjusted operating parameter for the at least one component includes adjusting an operating parameter to the adjusted operating parameter based on a stepped adjustment in response to a linear change or a non-discrete change in the first voltage indication; and operate the at least one component of the climate control system at the adjusted operating parameter.

Further example implementations may include a method of controlling a climate control system coupled to a microgrid power unit and configured to provide a stepped demand response, the climate control system including a controller and a plurality of components, at least one component of the plurality of components operably controllable by the controller, the method comprising: receiving a first voltage indication from the microgrid power unit, the microgrid power unit including a renewable power source; determining a second indication, the second indication indicative of a condition of at least one of the following the climate control system, the microgrid power unit, and a utility power grid; determining an adjusted operating parameter for the at least one component of the climate control system based on the first voltage indication and the second indication, wherein determining the adjusted operating parameter for the at least one component includes adjusting the operating parameter to an adjusted operating parameter based on a stepped adjustment in response to a linear change or a non-discrete change in the first voltage indication; powering the at least one component from a power supply provided by the microgrid power unit; and operating the at least one component of the climate control system at the adjusted operating parameter.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
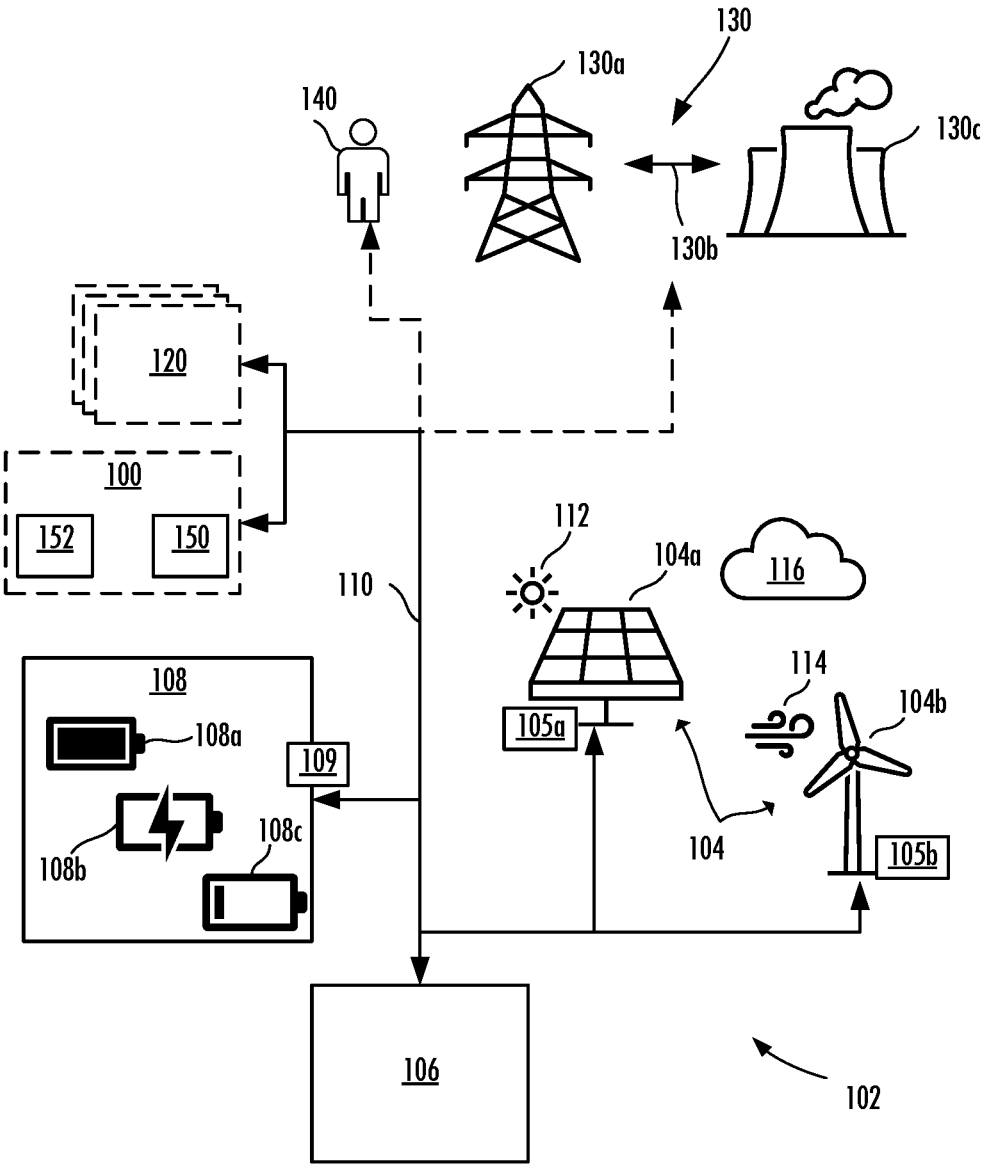
FIG. 1 illustrates a schematic diagram of a microgrid power unit, according to some example implementations of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the embodiments, examples, or implementations set forth herein; rather, these example embodiments, examples, or implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments, examples, or implementations of the described disclosure in the installed configuration (e.g., in an operational configuration). It is understood that such terms are not used in any absolute sense. Further, when used herein (including in the claims), the words "about," "generally," "substantially," "approximately," and the like mean within a range of plus or minus 10% unless otherwise stated herein.

The present disclosure relates to systems and methods for operating a climate control system on a direct current (DC) microgrid utilizing renewable sources of energy, such as photovoltaic or solar panels and wind turbines. In general, this disclosure focuses on utilizing a range of stepped or discrete demand responses with the climate control system to compensate for sporadic power generation associated with renewable energy sources of the microgrid. These discrete demand responses of the climate control system allow the system to react to non-discrete fluctuations in input power while reducing the likelihood of damage to the climate control system. Such responses may also allow the climate control system to more consistently maintain comfort settings of conditioned spaces.

As described above, utilizing climate control systems with renewable energy may be problematic for a number of reasons. As a result, there exists a need for solutions to these problems in order to operate climate control systems safely and effectively with renewable energy. Some solutions to such problems, as described by the present disclosure, include a climate control system configured to utilize a range of stepped or discrete demand responses to respond to inconsistent power input from a microgrid. While fluctuations of input power may occur on the microgrid, the climate control system may respond by increasing or decreasing its demand for power in stepped intervals.

For example, during a time period of increased power production a microgrid may be generating more power than can be stored, e.g., by a battery. In response to the excess power generation a climate control system may be configured to provide a load-up demand response in order to store or remove additional thermal energy from a conditioned space while the excess power is available. The load-up demand response of the climate control system allows the climate control system to use less power during a following time period when power production by the microgrid is less than optimal. Alternatively, the climate control system may utilize a curtailment demand response if the power being consumed exceeds the power generation of the microgrid and the time period aligns with peak utility grid hours, e.g., when costs increase due to increased demand. Additionally, the climate control system may utilize a curtailment demand response if the power being consumed exceeds the power generation and the utility company issues a demand response event, e.g., a request to reduce power consumption.

An advantage to such stepped demand responses is that the climate control system may maintain conditioning capacity for a conditioned space during this period of reduced power input. Thus, the climate control system can limit the impact that power fluctuations may have on occupant comfort within the conditioned space. Another advantage to such stepped demand responses is that the climate control system may reduce component strains associated with rapid and/or hard changes to input power.

Another solution to some aforementioned problems, as described by the present disclosure, may be to utilize climate control systems that can be powered directly by DC power without the need for an inverter. One advantage to such DC powered climate control systems is that they run more efficiently on a DC based renewable microgrid, e.g., without the extra power drawn by the inverter or other intermediary equipment. Thus, DC powered climate control systems may further compound the benefits and advantages associated with the stepped demand responses, such as faster demand response times, less power reduction, and leaner power consumption all while maintaining conditioning capacity.

Moreover, further advantages to such climate control systems, as described by the present disclosure, may include maximizing the service life of climate control systems by reducing strain on components associated with power fluctuations. This may provide the added benefit of reducing dealer warranty claims or homeowner repair costs. Further, homeowners may be able to reduce operating costs associated with their climate control systems without having to sacrifice their preferred comfort. Furthermore, strain on personal microgrids and local utility power grids may be substantially reduced by implementing DC powered climate control systems with stepped or discrete demand responses.

Further, the disclosed examples herein may also optimize instances where excess electrical energy is available from the microgrid. As described herein, a load-up setting may be utilized to allow the climate control system to convert the excess electrical energy into thermal energy, or other forms of energy. This helps optimize the energy provided from renewable sources as well as reduces energy consumption by the climate control system during times when lower energy is available from the microgrid and/or energy costs are elevated.

Figure 2:
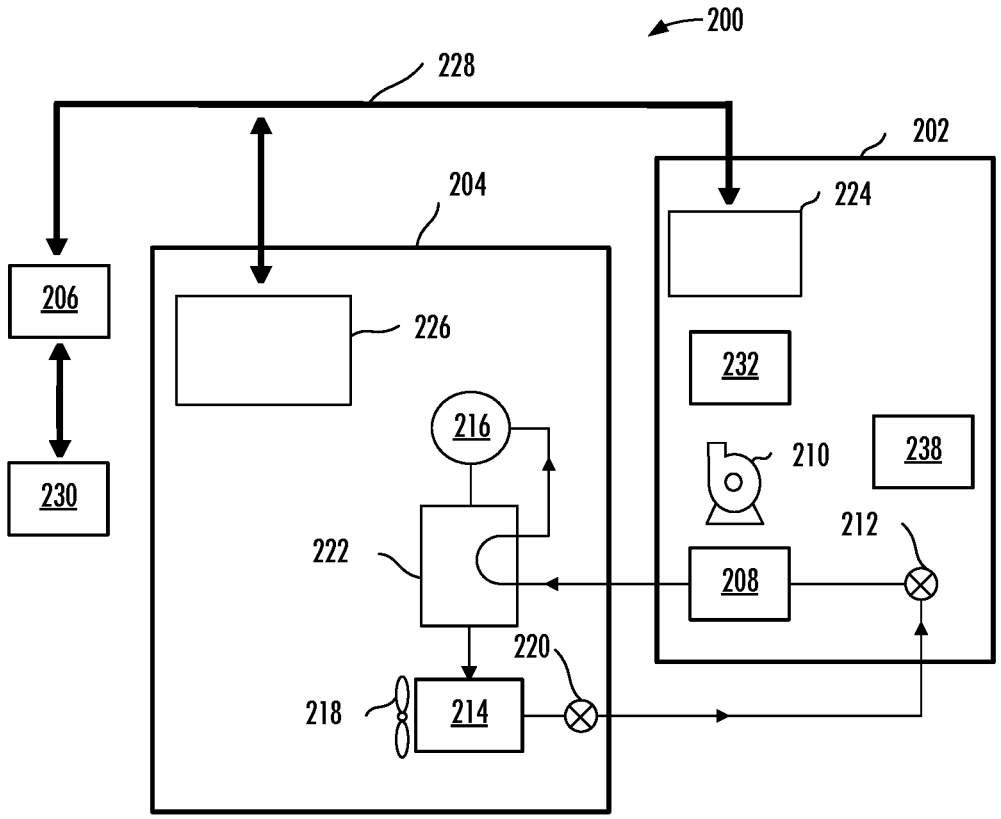
FIG. 2 illustrates a schematic diagram of a climate control system, according to some example implementations of the present disclosure.

Before going through further examples, an overview of an example microgrid and example climate control systems are provided in FIG. 1 and FIG. 2.

FIG. 1 shows a schematic diagram for at least an example climate control system 100 coupled to a microgrid power unit 102. It should be understood that the microgrid power unit comprises a portion of the microgrid as described by the present disclosure. While, in contrast, "microgrid" generally refers to all of the microgrid's infrastructure along with any appliances or other devices connected thereto.

Referring to FIG. 1, in the depicted example, the microgrid power unit 102 comprises one or more components of a microgrid that may be selectively operated to provide at least electrical power to one or more electrical loads coupled to the microgrid. The example depicted in FIG. 1 shows a microgrid power unit 102 configured as part of an open system microgrid with interfaces to external grid systems, e.g., with a utility grid 130 as shown in FIG. 1. Further, in some examples, the microgrid may include operable connections to external grid systems that may be selectively opened or closed, e.g., the microgrid may operate as an islandable microgrid. In some examples, the microgrid power unit 102 may be configured as part of a closed system, or stand-alone, microgrid without connection to external grid systems.

The microgrid power unit 102 includes at least one renewable power generator 104 (e.g., a solar powered generator 104*a*, a wind powered generator 104*b*, a water turbine (not shown), or the like), a microgrid controller 106, battery storage unit 108, and a communication bus 110. The microgrid power unit 102 may be connected to one or more climate control systems 100, a plurality of appliances 120, and potentially other devices. In some examples, the plurality of appliances 120 may include one or more of periodical appliances (e.g., dishwashers, clothes washing machines, clothes dryers, etc.), lighting systems, microwaves, ovens, stove burners, or the like.

The communication bus 110 may couple one or more components of microgrid power unit 102 for bidirectional communication and/or power distribution. In some examples, communication bus 110 may include a user interface (not shown) to allow interaction with a user 140 associated with the microgrid power unit 102. The communication bus 110 may further include, in some examples, a connection with a utility grid 130. In some examples, the communication bus 110 may utilize the same connections for both communication and power distribution. For example, the power conduit (e.g., power cable, busbar, etc.) that receives output power from a power source may be the same structure of the communication bus 110 that provides at least some operational information (e.g., voltage indication, environmental indication, power demand indications, future estimated indications, charge level indications, rates of change, and/or other indications described by the present disclosure). In some examples, the communication bus 110 may at least partially include a cloud-to-cloud interface.

The generator 104 may generally comprise one or more generative apparatuses and may convert one or more renewable sources of energy to electrical power for utilization by the microgrid. Examples of generative apparatuses include a photovoltaic cell or solar panel, wind turbine, water turbine, or other forms of electricity generators (e.g., dynamos, or the like.) configured to harness a renewable source of energy and provide power to the microgrid power unit. In some examples, the generator 104 may further include control circuitry, e.g., a panel controller 105*a*, a turbine controller 105*b*, or the like, for generally monitoring and controlling the generator 104. In some examples, the panel controller 105*a* and/or the turbine controller 105*b* may comprise, in whole or in part, power meters and/or sensors for monitoring the generator 104 and may generally provide indications of power availability to another controller. In some examples, the microgrid controller 106 may comprise, in whole or in part, the panel controller 105*a*, the turbine controller 105*b*, or the like. The combination of a generative apparatus and a renewable source of energy along with at least temporary power storage, in some examples, may define a renewable power source for the microgrid power unit 102.

Generator 104, in some examples, may include a solar panel, a wind turbine, and/or any other generative devices. In some examples, generator 104 may comprise a plurality of generators including renewable power sources and/or non-renewable power sources. Each generator 104 may include one or more sensors (not shown) to monitor environmental conditions 116 (e.g., storms, heavy wind, snow, etc.) associated with the generator 104 and/or operating parameters of the generator 104. Any sensors may be used in accordance with the disclosure herein. Further, the generator 104 may be configured, with an associated controller, to provide indications of power availability, e.g., voltage indications that are indicative of a current or future power output of the generator 104.

In the depicted example, the generators 104 include a solar powered generator 104*a*, which may include at least a solar panel including a photovoltaic cell. The solar powered generator 104*a* may convert renewable solar energy provided by the sun 112 to electrical power. The depicted example also includes a second generator 104, a wind powered generator 104*b*, which may include a wind turbine including one or more blades coupled to a generator. The wind powered generator 104*b* may convert motive power provided by the wind 114, e.g., renewable wind energy, to electrical power. As discussed above these are only examples of generators 104 which may be included in the examples described herein. Examples of renewable sources of energy may include solar energy, wind energy, water energy, geothermal energy, tidal or wave energy, or the like.

Still referring to FIG. 1, the microgrid controller 106 may direct power output by at least the solar powered generator 104*a* and the wind powered generator 104*b* to an input of battery storage unit 108. The battery storage unit 108 generally comprises at least a battery cell and may be configured to store power. The battery storage unit 108 may be configured as a mechanical battery, chemical battery, a combination thereof, or any other form of battery. The battery storage unit 108 may include a plurality of chargeable and/or rechargeable battery cells (e.g., alkaline battery, lithium-ion battery, water tank, compressed air tank, flywheel energy storage systems (FESS), etc.). In some examples, the battery storage unit 108 may further include control circuitry, e.g., a charge controller 109 as illustrated in FIG. 1, for generally monitoring and controlling the battery storage unit 108. In some examples, the charge controller 109 may comprise, in whole or in part, power meters and/or sensors for monitoring the battery storage unit 108 and may generally provide indications of power availability to another controller. In some examples, the microgrid controller 106 may comprise, in whole or in part, the charge controller 109.

In some examples, the battery storage unit 108 includes three sets of battery cells in different states. Fully charged battery cell 108*a*, charging battery cell 108*b*, and discharging battery cell 108*c*. More or less battery cells may be utilized and the battery storage unit 108 may control the operations of these cells in various different ways, including simultaneously charging, storing, and discharging energy from different battery cells. Further, the battery storage unit 108 may be configured, with an associated controller, to provide indications of power availability, e.g., voltage indications that are indicative of a current charge level of battery cells.

Still referring to FIG. 1, a user 140 may be associated with the microgrid power unit 102. Example users of the microgrid power unit 102 include an owner of the microgrid power unit 102, a homeowner, an installer and/or service technician of microgrid power unit 102 or climate control system 100, an electrician, a utility company employee, or the like. In some examples, the user 140 may provide inputs to the microgrid controller 106 or another controller. The user 140 may generally interface with microgrid power unit 102 via the communication bus 110. The microgrid controller 106 may be configured to generate, transmit, and/or interpret indications of power availability, e.g., voltage indications which indicate power availability from one or more power sources such as the generator 104 or the battery storage unit 108.

In the depicted example, a utility grid 130 is coupled to the microgrid power unit 102. The utility grid 130 may generally comprise a plurality of power conduits and communication connections 130*b* coupling power transmission lines 130*a* to power plants 130*c*. The utility grid 130 may interface with the microgrid power unit 102 via the communication bus 110. The utility grid 130 may generally generate power. The utility grid 130 may, in some examples, send and/or receive information to at least the microgrid controller 106, e.g., a demand response event, a request for power, or the like as described by the present disclosure. The utility grid 130 may be owned and operated by an entity separate from the microgrid power unit 102. In some examples, the utility grid 130 is coupled to the climate control system 100, potentially independent from the microgrid power unit 102.

In some examples, the user 140 and/or the utility grid 130 may be configured to interface with the microgrid power unit 102 and such interfaces may be at least partially considered a component of the microgrid power unit 102. The user 140 may generally be able to monitor power generation and consumption in relation to the microgrid power unit 102 via a user interface. Generally, the user 140 may be able to provide instructions to the microgrid power unit 102 such as to prioritize the climate control system 100 with respect to other electrical loads. The utility grid 130, or an agent thereof, may generally be able to provide instructions to the microgrid power unit 102, such as to utilize battery power instead of utility grid power during peak utility demand hours or to reduce demand. In some examples, the user 140 and/or the utility grid 130 may not be considered components of the microgrid power unit 102.

FIG. 1 further shows a schematic of a climate control system 100 coupled to the microgrid power unit 102. A more detailed discussion of an example climate control system is discussed in connection with FIG. 2. However, the example climate control system 100 shown in FIG. 1 includes a separate system controller 150 from the microgrid controller 106, and the system controller 150 controls the various climate control equipment 152, e.g., the controller 150 may cause adjustment of operating parameters of components such as speed, runtime, or the like for the various climate control equipment 152. The system controller 150 may be configured to receive, transmit, and/or interpret indications of power availability, e.g., voltage indications which indicate power availability from one or more power sources. In the example depicted in FIG. 1, this system controller 150 is separate from the microgrid controller 106, and communicates bidirectionally with the microgrid controller via communication bus 110. It is understood that system controller 150 may encompass one or more controllers, and that in some examples, system controller 150 includes some or all of the microgrid controller 106.

FIG. 2 shows a schematic diagram for at least an example climate control system 200, which may be the same or similar to the climate control system 100 as discussed above. The system controller 150 described above, for example, may be the same or similar to the system controller 206 as described in more detail below. Further, the various climate control equipment 152 may comprise one or more components described below with reference to the climate control system 200. Moreover, the components of the climate control system 200 may be provided, in some examples, in addition to the components of the climate control system 100. As an example, the system controller 150 may be an intermediate controller for interfacing the system controller 206 and the microgrid controller 106.

The climate control system 200, in some examples, comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The examples depicted in FIG. 2 are configured in a cooling mode. The climate control system 200, in some examples is configured as a split system heat pump system, and generally comprises an indoor unit 202, an outdoor unit 204, and a system controller 206 that may generally control operation of the indoor unit 202 and/or the outdoor unit 204.

Indoor unit 202 generally comprises an indoor air handling unit comprising an indoor heat exchanger 208, an indoor fan 210, an indoor metering device 212, and an indoor controller 224. The indoor heat exchanger 208 may generally be configured to promote heat exchange between a refrigerant fluid carried within internal tubing of the indoor heat exchanger 208 and an airflow that may contact the indoor heat exchanger 208 but that is segregated from the refrigerant fluid. Indoor unit 202 may at least partially include, or be coupled to, a duct system 232 including one or more of an air return duct, a supply duct, a register, a vent, a damper, an air filter, or the like for providing airflow.

Outdoor unit 204 generally comprises an outdoor heat exchanger 214, a compressor 216, an outdoor fan 218, an outdoor metering device 220, a switch over valve 222, and an outdoor controller 226. The outdoor heat exchanger 214 may generally be configured to promote heat transfer between a refrigerant fluid carried within internal passages of the outdoor heat exchanger 214 and an airflow that contacts the outdoor heat exchanger 214 but is segregated from the refrigerant fluid.

The system controller 206 may generally be configured to selectively communicate with the indoor controller 224 of the indoor unit 202, the outdoor controller 226 of the outdoor unit 204, and/or other components of the climate control system 200. In some examples, the system controller 206 may be configured to control operation of the indoor unit 202, and/or the outdoor unit 204. In some examples, the system controller 206 may be configured to monitor and/or communicate with a plurality of temperature and pressure sensors associated with components of the indoor unit 202, the outdoor unit 204, and/or the outdoor ambient environment.

Additionally, in some examples, the system controller 206 may comprise a temperature sensor and/or may further be configured to control heating and/or cooling of conditioned spaces or zones associated with the climate control system 200. In other examples, the system controller 206 may be configured as a thermostat for controlling the supply of conditioned air to zones associated with the climate control system 200, and in some examples, the thermostat includes a temperature sensor.

The system controller 206 may also generally comprise an input/output (I/O) unit (e.g., a graphical user interface, a touchscreen interface, or the like) for displaying information and for receiving user inputs. In some examples, a user may provide indications of temperature setpoints, humidity setpoints, fan setpoints, or other adjustable operating parameters for the climate control system, to the system controller 206 for controlling the supply of conditioned air. In some examples, the system controller 206 may be configured for selective bidirectional communication over a communication bus 228, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like.

The indoor controller 224 may be carried by the indoor unit 202 and may generally be configured to receive information inputs, transmit information outputs, and/or otherwise communicate with the system controller 206, the outdoor controller 226, and/or any other device 230 via the communication bus 228 and/or any other suitable medium of communication. Similarly, the outdoor controller 226 may be carried by the outdoor unit 204 and may be configured to receive information inputs from the system controller 206, which may be a thermostat. In some examples, the outdoor controller 226 may be configured to receive information related to an ambient temperature associated with the outdoor unit 204, information related to a temperature of the outdoor heat exchanger 214, and/or information related to refrigerant temperatures and/or pressures of refrigerant entering, exiting, and/or within the outdoor heat exchanger 214 and/or the compressor 216.

The indoor electronic expansion valve (EEV) controller 238 may be configured to receive information regarding temperatures and/or pressures of the refrigerant fluid in the indoor unit 202. More specifically, the indoor EEV controller 238 may be configured to receive information regarding temperatures and pressures of refrigerant fluid entering, exiting, and/or within the indoor heat exchanger 208. In some examples, the indoor EEV controller may be coupled to one or more devices, e.g., indoor metering device 212, to control opening and closing operations. In some examples, the one or more metering devices may be a thermal expansion valve, orifice plate, capillary tube, or the like which may not require remote modulation by the indoor EEV controller 238.

In some examples, at least a component of the climate control system 200 may be a DC powered component. For example, one or more of indoor unit 202, indoor fan 210, indoor metering device 212, indoor controller 224, outdoor unit 204, compressor 216, outdoor fan 218, outdoor metering device 220, switch over valve 222, an outdoor controller 226, system controller 206, communication bus 228, or any other components of a climate control system described by the present disclosure may be operated at least partially with DC power. For example, the compressor 216 may be a DC powered compressor with a rated voltage, potentially 350V. In some examples, a DC powered compressor (or other components) may be preferable because these components may be powered by the microgrid power unit 102 without converting the power supply to an AC current, and the associated inefficiencies.

In some examples, the climate control system may utilize one or more types of electricity, for example direct current (DC), alternating current (AC), or some combination thereof. Climate control systems that utilize DC electricity may utilize DC motors for components such as the indoor fan or outdoor compressor. In some examples, the climate control system may comprise DC specific safety equipment such as DC circuit breakers, e.g., thermal, ground fault, arc fault or the like. Additionally, the service disconnects between the climate control system and the microgrid may be specific for DC electricity. For example, a DC disconnect may be coupled between a solar panel and the climate control system in order to manually shut-off power to the climate control system.

As discussed above, this disclosure is directed to example climate control systems that provide improved performance when coupled to a microgrid. In some examples, this improved performance may be achieved by utilizing the components discussed above in connection with the process 300 shown in FIGS. 3A and 3B, and further described herein. In some examples, the climate control system 100 and/or the microgrid power unit 102 may utilize one or more processes to optimize the controls of the climate control system 100 powered, at least in part, by the microgrid power unit 102.

Figure 3A:
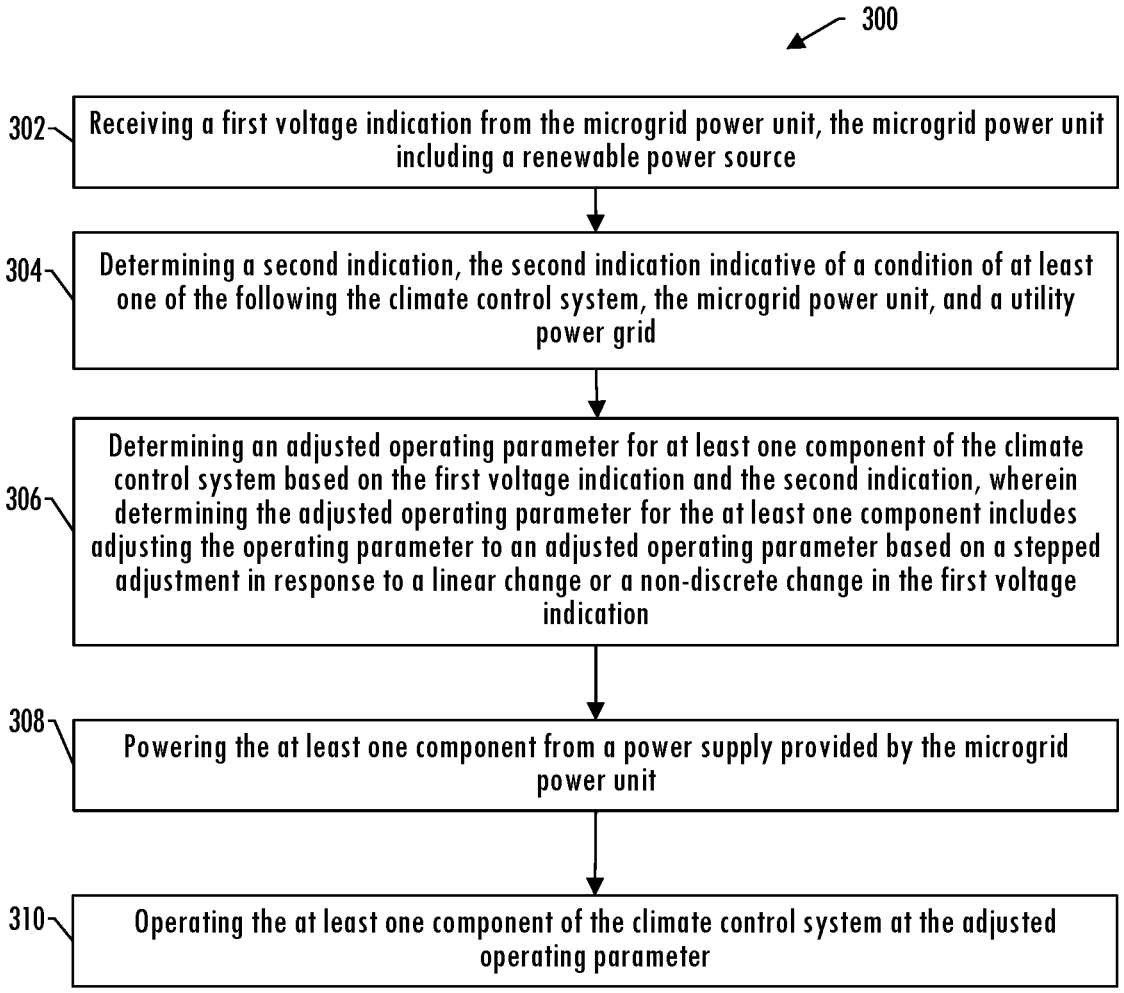
FIGS. 3A and 3B illustrate processes for operating a climate control system with demand responses, according to some example implementations of the present disclosure.
Figure 5:
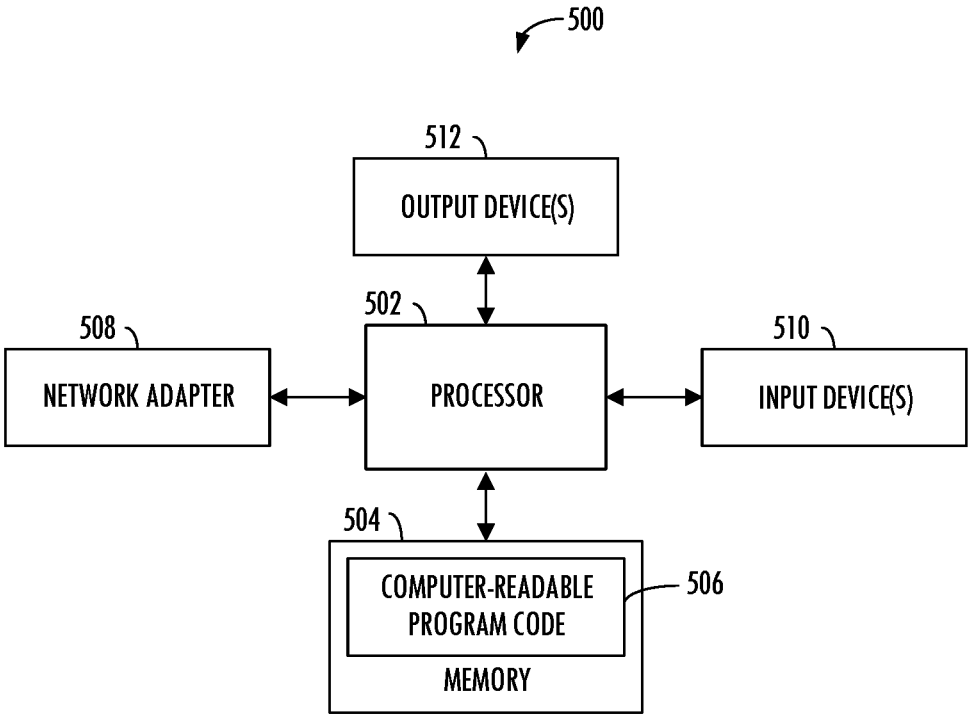
FIG. 5 illustrates control circuitry, according to some example implementations of the present disclosure.

FIG. 3A provides an illustration of an example process. Process 300 may be carried out, at least partially, by one or more apparatuses, components, circuits, or the like according to some examples of the present disclosure. For example, process 300 may be performed by at least system controller 150, the other controllers referenced in this disclosure, or any other similar devices described by the present disclosure (e.g., control circuitry 500 as illustrated in FIG. 5 and described below).

As shown in FIG. 3A, the process 300 may include receiving a first voltage indication from the microgrid power unit, the microgrid power unit including a renewable power source, as shown in step 302. In some examples, the microgrid power unit may include one or more power sources (e.g., generator, battery, or the like) associated with the microgrid power unit 102 and any circuitry associated therewith for at least monitoring and/or reporting conditions of each power source. In some examples, a microgrid may comprise a plurality of microgrid power units. The process may include determining a second indication, as shown in step 304. The second indication may be indicative of one or more conditions as described further by the present disclosure.

The process may include determining an adjusted operating parameter for at least one component of the climate control system based on the first voltage indication and the second indication, as shown in step 306. In some examples, the determined adjusted operating parameter may include adjusting an operating parameter based on a stepped adjustment in response to a linear change or a non-discrete change in the first voltage indication. For example, the operating parameter may be an adjustment to the maximum power consumption for a given component, e.g., the compressor, or a setting, e.g., maximum capacity setting, etc. It should be further understood, that the climate control system may provide a stepped or discrete electrical demand response in response to the first voltage indication or other electrical power fluctuations; however, the climate control system may provide linear conditioning demand responses in response to conditioning indications or requests, e.g., a temperature, humidity, or fan speed setpoint. For example, the adjusted operating power may set a revised maximum power level, which may be decrease in a stepped fashion, however, the unit itself may still draw power in a linear fashion up to the adjusted maximum power level setting based on the underlying demand of the conditioned space.

Further, the process may include powering the at least one component from a power supply provided by the microgrid power unit, as shown in step 308. The power supply, in some examples, may comprise electricity, e.g., DC, AC, or a combination thereof, and/or any components for providing the electricity. In some examples, the electricity of the power supply may be altered by a control circuit to carry indications or other information along with electrical power. The process may include operating the at least one component of the climate control system at the adjusted operating parameter, as shown in 310. Each of these steps will be described in more detail below along with further examples of this process.

In some examples, the first voltage indication is indicative of a power level or output rate of the microgrid power unit (e.g., a generator, a battery, the like, or a combination thereof). For example, the first voltage indication may provide an indication of the level of power generated by one or more of the generators 104, e.g., the solar panel is converting solar energy into electricity at its rated electrical capacity. In some examples, the first voltage indication provides an indication of the power level of the microgrid power unit 102 overall. For example, the first voltage indication may be indicative that the battery storage unit 108 is fully charged and/or that more power is being generated than consumed. In some examples, the first voltage indication is the voltage of DC power supplied via the microgrid power unit 102 to the climate control system 100, potentially via the communication bus 110.

In some examples, the first voltage indication, or the second indication described in further detail below, may be indicative of a linear change, a discrete change, or some combination thereof provided from the microgrid or the utility grid. For example, a linear change may be associated with an amount of power available from the utility grid, an amount of power generated from a renewable source, or a remaining charge level of a battery as described above. Further, a linear change may be associated with environmental conditions, e.g., ambient outdoor temperature, relative indoor humidity, or the like. Additionally, an indication may be indicative of a discrete change that may be associated with a time of use rate, e.g., cost of utility grid power over a given time period such as during peak usage hours. The cost of using power from the utility power grid may step-up or step-down according to incremental amounts which may result in the climate control system providing a load-up or curtailment demand response based on a cost analysis and/or other indications. Further, the discrete change may be associated with a demand response event from the utility grid, as described in further detail below, and the demand response event may be a request from the utility grid for at least the climate control system to operate according to a load-up or curtailment demand response, e.g., at a predefined increment for a predefined time.

The first voltage indication may be received in any manner. In some examples, the first voltage indication may be received through a wired or wireless communication system utilizing one or more various different protocols including pulse width modulation, CTA2045, I2C, SPI, CAN, Ethernet, WiFi, Bluetooth, Zigbee, or Zwave. The first voltage indication may, in some examples, be received with electrical power through a shared or common power conduit, for example a power cable or busbar, e.g., utilizing power/signal dual modulation to embed an indication into a power signal. In some examples, the first voltage indication may be associated with a present/current power availability indicative of power that may be provided to the climate control system or other devices, e.g., periodical appliances, lighting systems, or similar devices described herein. In some examples, the first voltage indication may be a measurement of input power to the climate control system and may be directly measured and/or continuously monitored by a system controller of the climate control system. For example, the system controller of the climate control system may continuously monitor input voltage, e.g., using a voltmeter or the like, to the climate control system and respond to changes in the monitored input voltage in real-time with a demand response.

In some examples, the process 300 may include receiving a second indication. The second indication may be generally an indication that assists the process in determining whether the operation of a component of the climate control system 100 should be adjusted and/or how the operation of the component of the climate control system 100 should be adjusted. For example, the second indication may be indicative of conditions of the climate control system 100, the microgrid power unit 102, the utility grid 130, and/or other sources. In some examples, the second indication is indicative of the power demand required by climate control system 100 and/or other devices (e.g., appliances 120 or the like) coupled to the microgrid power unit 102. In some examples, the second indication may provide an indication as to whether the climate control system can or should adjust operations of one or more components of the climate control system based on a power level of the microgrid power unit 102.

To walk through illustrative examples, the second indication may provide an indication of the conditioning load requested by conditioned spaces serviced by the climate control system 100. For example, the second indication may provide an indication as to whether a curtailed response may be adequate to handle the load, e.g., whether the thermal load of the conditioned space requires more than 50% heating or cooling capacity to maintain stable conditions. Further, in some examples, the second indication may be indicative of a criticality of operation for the climate control system. For example, the second indication may be indicative of the presence of (or absence of) contents having specialized conditioning requirements, e.g., vaccines requiring low temperatures, contents of a freezer, etc.

In some instances, the second indication is indicative of a user preference, e.g., during certain scheduled times or events a user may require a full conditioning load be provided. Other similar indications may be provided by the second indication. The user may provide, for example, an override indication to prevent operating the at least one component of the climate control system at the adjusted operating parameter. The override indication may cause the climate control system to prioritize maintaining a user defined setpoint (e.g., temperature, humidity, fan speed, or the like) to within a user defined setpoint offset. In some examples, the override indication may indicate that the user prefers to opt-out of, or disable, the climate control system from utilizing any or all demand responses if the user defined setpoint offset is exceeded. For example, determining the adjusted operating parameter for a component of the climate control system according to an associated demand response may include adjusting a user defined setpoint offset for the climate control system. In some examples, the user defined setpoint offset, or any other setpoint offset described below, may define a range of values above or below the user defined setpoint, e.g., +4° F. for temperature, +5% for relative humidity, etc. Still a setpoint offset may utilize greater or lesser values above or below a setpoint.

The override indication, in some examples, may comprise a maximum and/or minimum setpoint offset that the climate control system may deviate from a setpoint during a demand response time period. For example, a user may indicate that a load-up and/or curtailment demand response may be utilized until the temperature of a conditioned space deviates above or below the user defined setpoint by more than 15° F. In some examples, the climate control system may have a predefined setpoint offset as a default setting, e.g., 4° F. In some examples, a respective setpoint offset may be defined separately for a load-up demand response and a curtailment demand response.

In some examples, an override indication may automatically cease operation of the climate control system during a demand response based on a safety threshold. For example, during a load-up and/or curtailment demand response an override indication may be automatically generated by a system controller when a determination is made that the temperature of a conditioned space is too high or too low, e.g., above 95° F. in cooling mode or below 47° F. in heating mode. The safety thresholds may be defined by a user or they may be predefined by the manufacturer. In some examples, the automatic safety threshold may be separately defined for each respective mode of the climate control system, e.g., heating, cooling, defrost, dehumidification, and/or other modes described herein.

In some examples, the second indication may be an indication of a power demand from additional electrical devices, e.g., periodical appliances, lighting systems, or the like, associated with a microgrid or utility power grid. For example, the second indication may be indicative of an amount of power consumption in Watts (W) of a lighting system coupled to a microgrid, or the second indication may indicate a high load device, e.g., dyer, is operating. In some examples, the second indication may be indicative of an environmental condition 116 associated with a microgrid that may affect power input or output to the microgrid. For example, the environmental condition 116 may be one of at least an ambient outdoor air temperature, an ambient outdoor air humidity level, weather patterns, or the like that may affect power consumption by a climate control system or that may affect power production of a solar panel.

In some examples, the second indication may be indicative of the conditions of the microgrid power unit 102. For example, the second indication may be a more recent or updated indication of the first voltage indication and may be further used to determine a rate of change of power availability between the first and second indications. In some examples, the second indication may be a charge level or the like of a battery storage unit, the charge level may be associated with one or more cells of the battery storage unit. For example, the charge level may indicate a total available percentage of the battery storage unit relative to a maximum power storage capability (e.g., in VDC or the like) of the battery storage unit. In some examples, the second indication may provide an indication that one or more other devices, e.g., periodical appliances, at least temporarily paused and/or reduced operations to reduce power consumption.

In some examples, the second indication is indicative of conditions of the utility grid 130. For example, the second indication may be indicative that a utility grid company is providing a demand response event, making usage of power from a microgrid more desirable. A demand response event may include instructions to utilize battery power during peak utility grid demand times and may further include instructions to recharge the battery power of the microgrid during off-peak utility grid demand times. Further, a demand response event may include instructions to reduce, pause, or cutoff power to one or more appliances, e.g., climate control systems, periodical appliances, lighting systems, or the like.

Furthermore, in some examples, the second indication may be indicative of a level of thermal storage or the like. In some examples, a climate control system may be implemented with one or more phase change materials and a second indication may indicate to the climate control system how much thermal energy is stored in the phase change materials. The phase change materials may be measured directly with a temperature sensor, e.g., thermistor or the like, or the climate control system may be configured with a model to calculate or estimate the thermal energy stored in the phase change materials. The climate control system may utilize one or more algorithms described by the present disclosure, or substantially similar modeling techniques, to calculate or estimate the thermal energy stored in the phase change materials. In some examples, a combination of temperature measurements and modeling techniques may be used by a system controller of the climate control system to determine a level of thermal storage. It is further understood that other indications may be provided by the second indication, and/or the process discussed herein may utilize a combination of indications discussed above as part of the disclosed process.

Further, the second indication may also be determined from any process, including any communication process discussed in this disclosure, e.g., using various different protocols including pulse width modulation, CTA2045, I2C, SPI, CAN, Ethernet, WiFi, Bluetooth, Zigbee, Zwave, or the like. For example, the second indication may be received with electrical power through a shared or common power conduit, for example a power cable or busbar, e.g., utilizing power/signal dual modulation to embed an indication into a power signal. In some examples, the first indication and the second indication may be configured into the same or different communications to be interpreted by the climate control system. The second indication may be a second voltage indication indicative of a utility power grid power availability, or another power availability not indicated by the first voltage indication. In some examples, various sensors associated with the climate control system provide information regarding the operation of the system and/or the conditioned space serviced by the system, and the process determines the second indication based on the information provided by these sensors. Indeed, the second indication may be received by any of the communication methods described above and/or determined through any method. In some examples, the second indication may be indicative of a load calculation provided by one or more thermostats of the climate control system.

As shown at step 306, the process 300 may further include determining an adjusted operating parameter for at least one component of the climate control system based on the first voltage indication and the second indication. In these examples, determining the adjusted operating parameter for the at least one component may include adjusting an operating parameter to the adjusted operating parameter based on a stepped adjustment in response to a linear change or a non-discrete change in the first voltage indication.

This process step 306 may be accomplished in various different manners. In some examples, the first voltage indication and/or the second indication may provide an indication that the operation of the climate control system 100 should (or should not) be operated on power supplied by the microgrid power unit 102. For example, if the first voltage indication indicates that components operating based on power from the microgrid should be curtailed and the demand on the climate control system cannot be met by a reduced conditioning capacity, then the process may determine that additional power sources, e.g., the utility grid, are required to continue appropriate operation of the climate control system. However, if the process step 306 determines based on the first voltage indication and/or the second indication that the microgrid power unit 102 is providing sufficient power, then other adjustments may be made. The below description walks through illustrative examples of adjustments that may be made according to the process described herein.

The process step 306 may include determining the adjusted operating parameters based on a plurality of operating parameters that collectively define an operating level of the climate control system. For example, each operating parameter may correspond to a first voltage indication and/or a range of first voltage indications. In some examples, the plurality of operating levels includes one or more of a shut-off level or 0% level, a 40% level, a 70% level, a 100% level, and/or at least one load-up level. For example, during load-up the conditioning demand may be increased by 30%, e.g., increasing the current demand up to a 130% level. Other values may be used, and in this example, the process may determine which operating level is appropriate for the component(s), associated with the operating parameters, based on the first voltage.

In some examples, the climate control system may operate according to a plurality of operating parameters and a plurality of operating levels or ranges. Each of the operating levels or ranges may define a level of performance of the climate control system that is possible using the plurality of operating parameters. Each operating level or range may correspond to one or more power availability indications, for example a voltage indication or a range of voltage indications provided from the microgrid power unit to the climate control system. In some examples, an operating level or range may define a level of performance of the climate control system that is possible using various different combinations of operating parameters. In some examples, the various different combinations of operating parameters may define the same or different sets of pluralities of operating parameters. In some examples, an operating level and/or an operating parameter may be associated with the operating mode of the climate control system as described by the present disclosure.

The climate control system may, in some examples, respond to increased or increasing power availability from the microgrid by increasing one or more operating parameters up to a higher operating level. For example, the microgrid may include a fully charged battery storage unit along with a solar panel and wind turbine both providing 100% of their respective power outputs. The climate control system may determine the increased power availability, such as from indications from the microgrid controller, and in response, the climate control system may increase conditioning (e.g., heating, cooling, humidifying, dehumidifying) capacity for a conditioned space up to 100% of the requested conditioning demand. It should be understood that, in some examples, the climate control system may be limited by a maximum system conditioning capacity that may be less than 100% of the requested conditioning demand. In some examples, the climate control system may increase beyond the requested conditioning demand, for example the climate control system may load-up to the requested conditioning demand by an amount (e.g., up to 130% of demand), potentially to convert the excess electrical energy into stored thermal energy.

In some examples, the climate control system may operate according to an advanced load-up demand response which would cause the climate control system to operate at the total 100% nominal conditioning capacity of the climate control system, regardless of a requested conditioning demand. The advanced load-up demand response may be used to potentially convert the excess electrical power into stored thermal energy. It should be understood that the total 100% nominal conditioning capacity of the climate control system may, in some examples, exceed a load-up demand response limited to 130% of a requested conditioning demand.

Figure 4:
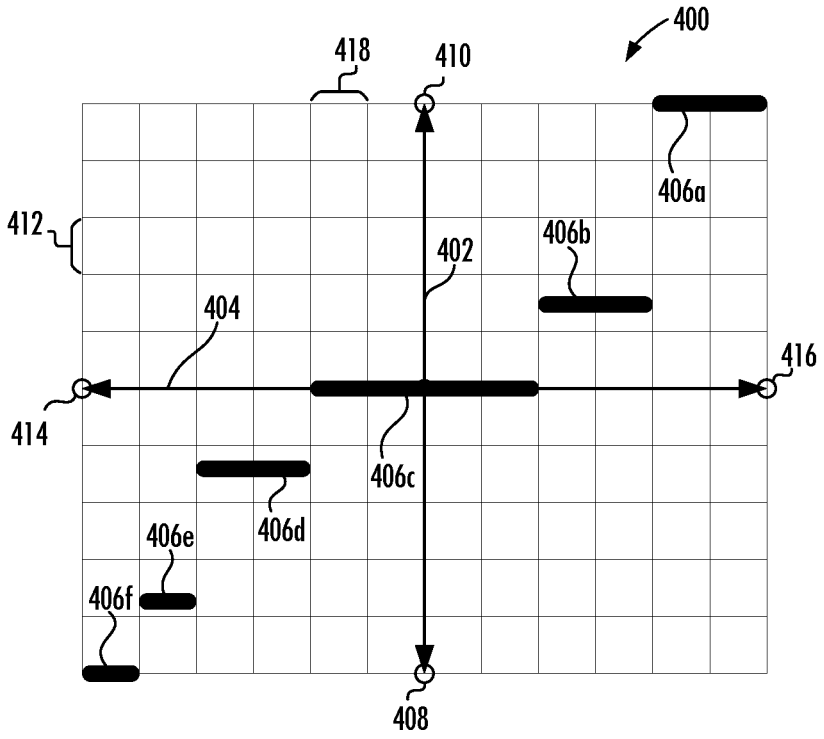
FIG. 4 illustrates a graphical representation of demand responses, according to some example implementations of the present disclosure.

Indeed, in some examples, the process 300 may map different operating parameters to the first voltage indication or other indications, e.g., a second indication, a conditioning capacity, power consumption, demand responses, or the like. FIG. 4 provides examples of this type of mapping. FIG. 4 shows a graph 400 representing examples of demand responses for a climate control system (e.g., 100 or the like). In this graph 400 the demand response for the climate control system is adjusted based on an input power level, e.g., the first voltage indication provided by the microgrid power unit to the climate control system. However, it should be understood that other indications as described by the present disclosure may be equally applicable to the responses described with respect to FIG. 4, e.g., a second indication including a demand response event, a level of thermal storage, or other indications as described herein. In particular, the graph 400 represents a plurality of demand responses in relation to a plurality of power input values and a plurality of conditioning capacity outputs settings for the climate control system.

Moreover, while graph 400 is described with respect to the conditioning capacity of the climate control system, it should be understood that other measures indicative of outputs of a climate control system may be similarly applicable to graph 400. For example, the demand responses may each be associated with a plurality of power consumption values for a component measured in Kilowatts (kW) (or the like) in place of, or in addition to, the conditioning capacities as described below with respect to FIG. 4. For example, a compressor may be driven by a DC motor and the DC motor may operate over a wide range of voltage, and/or current, inputs; including inputs above or below the DC motor's rated input value. In some examples, the speed setting of a DC motor may be controlled by adjusting its voltage input, e.g., in VDC. For example, by increasing or decreasing the voltage input into the DC motor, the DC motor's speed setting will proportionally increase or decrease allowing for greater or lesser power consumption by the DC motor, e.g., in kW. In some examples, the speed setting of a DC motor, e.g., brushless DC motor, may be controlled by adjusting the current pulse-width modulation (PWM). Furthermore, as a result, the compressor driven by the DC motor will contribute to the delivered conditioning capacity of the climate control system proportionally to the DC motor's speed setting. To reiterate, the voltage input, and/or other input, provided to a DC motor may dictate the motor speed setting, and thus the motor power consumption, which in turn may dictate the compressor speed setting and, thereby, at least a portion of the corresponding conditioning capacity setting of the climate control system.

In the depicted example, the vertical axis 402 represents conditioning capacities that may be output by the climate control system, or a component thereof. The conditioning capacities may be a percentage relative to the total nominal capacity of the climate control system or, in some examples, the conditioning capacities may be a percentage relative to the requested demand capacity requested from the climate control system. The horizontal axis 404 represents examples of the power input level to the climate control system, or a component thereof, e.g., the horizontal axis 404 may represent first voltage indication values. The demand response settings 406*a*-406*f* show example demand responses for the climate control system, or a component thereof (e.g., compressor 216, etc.), mapping the power input level (e.g., the first voltage indication or the like) to a corresponding conditioning capacity setting for the climate control system, or component.

To walk through graph 400 in more detail, the vertical axis 402 is representative of a relative conditioning capacity increase or decrease for the climate control system, or component thereof. In this example, the conditioning capacity is shown as the vertical values along the vertical axis 402. In this depicted example, increases in the conditioning capacity from the rated capacity are shown as values move along vector 410, e.g., up the vertical axis, and decreases in the conditioning capacity from the rated capacity are shown as values move along vector 408, e.g., down the vertical axis. The graph 400 further provides output units 412 as vertical grid lines to provide reference. In some examples, the output units 412 may be representative of a percentage relative to the requested conditioning demand or a percentage relative to the total nominal conditioning capacity of the climate control system, e.g., 70% of the requested conditioning demand, 100% of the total nominal conditioning capacity, or the like.

It is understood that in some examples, the output units 412 may be representative and may change based on whether the first voltage indicator indicates the output units should be decreased or increased relative to a demand response. For example, the output units may be representative of a rated conditioning demand, and when the first voltage indicators indicate the system should be curtailed, e.g., decreased or stepped down to a lower demand response, the output units may decrease the requested capacity by a given level. However, when the first voltage indicators indicate the system should load-up, e.g., be increased or stepped up to a higher demand response, it may be impractical, impossible, or undesirable to increase the rated capacity of the system. Thus, the system may utilize the excess energy provided in a different load-up setting, e.g., driving the system over the requested demand of the system by a given level, e.g., up to a total capacity of the system. Other examples will be described in more detail below and/or may be utilized.

In some examples, the output units 412 may be representative of a standardize conditioning capacity unit such as British thermal unit per hour (Btu/h), kW, tons, or the like. It should be understood that a percentage relative to the requested conditioning demand or the total nominal conditioning capacity of the climate control system may also be representative of a numerical value and a standardize conditioning capacity unit, and vice versa. For example, conversions may be made, e.g., by a controller, between percentages and relative unit values given the requested demand and/or total nominal capacity.

The horizontal axis 404, in the depicted example, is representative of power input values, e.g., the power supplied by the microgrid power unit 102. In some examples, the horizontal axis 404 may be representative of the first voltage indication. In the depicted example, the horizontal axis 404 is representative of an actual value associated with the power input to the climate control system or a component thereof. For example, the horizontal axis points along the horizontal axis 404 may be the rated or expected power input value, e.g., 350 VDC or the like. In this example, the power input values increase as the values move horizontally to the right of the graph 400, e.g., along vector 416, and decrease as the values move horizontally to the left of the graph 400, e.g., along vector 414. The graph 400 further provides power input value units 418 as horizontal grid lines to provide reference. In some examples, the power input value units 418 may be representative of a fixed numerical value, a percentage of an electrical rating for the climate control system, and/or standardized electrical unit, e.g., 10 VDC, 3% of 350 VDC, or the like.

The depicted example in graph 400 further includes demand response settings 406*a*-406*f* mapping the demand responses for a climate control system, or component thereof, between the power input values and the rated conditioning capacity percentages or the like (e.g., power consumed by the climate control system in kW). As shown in this example there are various demand responses (406*a*, 406*b*, 406*c*, 406*d*, 406*e*, 406*f*). In this example, each of these demand response settings 406*a*-406*f* correlates a rated power level for the climate control system to a power input value provided to the climate control system by the microgrid. Further, as shown in the depicted example in FIG. 4, the correlation specifies that the maximum delivered conditioning capacity changes in a stepped fashion based on a linear or non-discrete change in the power input value, which as discussed herein has various advantages.

In some examples, process 300 may use the graph 400 (or similar mapping) to determine the adjusted operating parameter. For example, if the power input value is within a range of expected values then the process may set the adjusted operating parameter to the rated voltage in order to achieve a corresponding conditioning capacity. For example, the climate control system may utilize demand response 406*c* to operate at a baseline or rated conditioning capacity in response to power input values between approximately 340 VDC and 360 VDC.

If the power input level increases above a given level, then the process 300 may increase the delivered conditioning capacity by the climate control system. For example, the power input level may increase above 360 VDC causing operation according to the settings of the demand response 406*b* and further causing the climate control system to load up. In this example, the load up setting increases conditioning capacity up to 30% more than the requested demand. In other examples, that may be impractical or undesirable, and thus, the load-up demand response at 406*b* may increase the requested conditioning demand by various different amounts, e.g., 5%, 10%, 20%, etc., in order to store the excess electrical energy by over delivering requested capacity in some manner. Similarly, the demand response 406*a* may provide a higher level of load-up setting which may provide a higher setting over that which is provided by the demand response at 406*b*. Thus, the process may determine the adjusted operating parameter based on an increased demand response, e.g., 406*b* or 406*a*.

If the power input level decreases below a given level, then the process 300 may decrease the operating power level of the climate control system, or component thereof. For example, the process may determine the adjusted operating parameter based on a decreased demand response, e.g., 406*d*, 406*e*, or 406*f*. For example, the power input level may decrease below 340 VDC causing operation according to the settings of the demand response 406*d* and further causing the climate control system to decrease conditioning capacity down to 70% of the rated conditioning demand of the system. In this example, the adjusted operating setting may be to set the maximum conditioning demand setting up to 70% of the rated conditioning capacity.

Turning back to FIG. 3A, in still further examples, the process 300 may estimate a rate of change for the power input value and select the operating power level based on this rate. For example, as discussed above, the second indication may be a second input voltage (or multiple additional input voltages), and the process 300 may determine a rate of increase or decrease of the input power level. The process may determine this estimated rate of change through any known method, e.g., regression analysis, historical trends, calculations, decision trees, time series analysis, Bayesian networks, neural networks, and/or other supervised or unsupervised artificial intelligence algorithms.

Based on this estimation, at step 306, the process 300 may determine an estimated future power input level, potentially at a given time, and make a determination that the maximum conditioning capacity setting should be adjusted further. For example, the present power input value may indicate that the demand response maps to normal operation, e.g., 406*c* of graph 400, indicating that one or more components (e.g., compressor 216, indoor fan 210, etc.) of the climate control system should be operated at their rated voltage and/or baseline output. However, the second indication may show that the input power level is decreasing at a given rate. Based on this rate of decrease the process may determine that the input power level will map to a lower conditioning capacity within a given time period, potentially within a standard cycle time for a climate control system or a standard time measurement, e.g., a day. In these examples, at step 306, the process may determine that the adjusted operating parameter should be set to the lower maximum conditioning capacity to avoid disruption or inconsistent conditioning during the period of time. Other determinations may be similarly made, e.g., based on kW of power consumed by the climate control system.

Turning back to FIG. 4, to walk through another example implementation of various demand responses with reference to the various numerical values and ranges which may be attributed to the graph 400. In this example, the demand response may correspond to a maximum capacity setting, or the like, for a DC compressor, which may correspond to a maximum power consumption, e.g., kW. In this example, the compressor has a rated input voltage of 350V. Further, in this example, the process 300 is adjusting the operating power level of the compressor at step 306 based on the first voltage indication. It should be understood that the power consumption in kW, or the like, for the DC compressor may further correspond to a delivered conditioning capacity by the climate control system. As described above, the voltage input, and/or other inputs (e.g., current PWM), provided to a DC motor may dictate the motor speed setting, and the motor's power consumption, which in turn may dictate the compressor speed setting and, thereby, at least a portion of the corresponding conditioning capacity setting of the Still with reference to FIG. 4, the vertical axis 402 may represent increases or decreases in the maximum capacity setting for the compressor, e.g., in order to increase or decrease the power consumption of the compressor. Thus, in this example, vertical values along the vertical axis 402 represent a conditioning setting for the compressor that corresponds to a power consumption setting, e.g., a maximum conditioning setting corresponding to a maximum power consumption at that setting. These values moving up the vertical axis 402 represent increased settings for the compressor, e.g., increased delivered conditioning capacity that is available only at increased power levels, and values moving down the vertical axis 402 represent decreased capacity settings, e.g., lowering the maximum capacity setting for the compressor which corresponds to a lower maximum power consumption. In this example, the output units 412 are in power units, e.g., kW of power consumption.

Additionally, in this example, the vertical axis 404 is representative of the first voltage indication. In some examples, the input power to the compressor may increase or decrease according to a demand. For example, the compressor may be supplied with 0 VDC when the compressor is off and the supplied power may increase up to a maximum capacity requiring 350 VDC, for example, to output 5 kW. Such voltage input values may be represented by the power input value units 418 relative to the horizontal axis 404. In this example, power input value units 418 are in voltage/current units, e.g., VDC of power supplied. It should be understood that the actual values of the output units 412 and/or the power input value units 418 may vary depending on specific components and equipment models of the climate control system.

Further, in this example, the demand responses are mapped to compressor demand level settings which again correspond to power levels. Thus, in this example, the first demand response 406*a* is an advanced load-up demand response, demand response 406*b* is a load-up demand response, demand response 406*c* is the rated demand response, demand response 406*d* is a general curtailment demand response, demand response 406*e* is a curtailment demand response, and the demand response 406*f* in this example corresponds to a critical curtailment demand response.

To provide further numerical examples, in this example, if the process receives a first voltage input value between 340 VDC and 360 VDC along the input axis 404, then the graph 400 indicates a rated or nominal capacity level which corresponds to the rated or nominal power consumption value along the vertical axis 402. In this example, the input voltages map to demand response 406*c* which corresponds to the rated or nominal power consumption value for the compressor. Thus, the process may determine that the adjusted operating parameter for the compressor should correspond to the requested load. In some examples, the power input value between 340 VDC and 360 VDC may include a demand response to return to a rated or nominal power consumption value from another operating level with another power consumption value, e.g., down from a load-up, or up from a curtailment demand response.

In the depicted example, a first voltage input value between 360 VDC and 370 VDC along the input axis 404 may indicate a load-up demand response with an increased power consumption value for the compressor in order to increase the delivered conditioning capacity, e.g., to potentially store the excess electrical power as thermal energy. In this example, the input voltage maps to the demand response 406*b*, which corresponds to a delivered capacity over the requested conditioning load. For example, the compressor may over deliver capacity, which results in an excess electrical draw for the compressor, or DC motor thereof, over the requested energy draw. In this example, the compressor may still operates within its rated capacity, but it over delivers capacity over the requested load to store the excess electrical energy as thermal energy. In some examples, the system drives the compressor at a percentage over the requested load, e.g., up to 130% of the requested load, to achieve this load-up condition. In some examples, a first voltage input value between 370 VDC and 380 VDC along the horizontal axis 404 may map to the demand response 406*a*. In this example, the demand response 406*a* may indicate an advanced load-up demand response corresponding to driving the compressor at an even higher level of delivered capacity over the requested capacity, e.g., up to 150% of requested load. In some examples, the demand response 406*a* may indicate an advanced load-up demand response corresponding to delivering a total nominal conditioning capacity of the climate control system. The advanced load-up demand response corresponding to delivering a total nominal conditioning capacity may be achieved by driving the compressor at a maximum rated power consumption setting, e.g., 5 kW of power consumption.

Moreover, in the depicted example, a first voltage input value between 330 VDC and 340 VDC along the horizontal axis 404 may indicate a general curtailment demand response. In this example, the input voltage maps to demand response 406*d*, which corresponds to a power decrease for the compressor, and thus may result, in a lower maximum capacity setting for the compressor. For example, the setting may correspond to a maximum setting of 70% of the rated capacity, which may correspond to a decrease by approximately 1.5 kW compared to the rated power draw for the compressor. In the depicted example, a first voltage input value between 325 VDC and 330 VDC along the horizontal axis 404 may indicate a critical curtailment demand response. In this example, the input voltage maps to demand response 406*e*, which may correspond to a setting for 40% of the rated capacity for the compressor and, in this example, a decrease by approximately 3 kW of the rated power draw for the compressor. In the depicted example, a first voltage input value between 325 VDC and 320 VDC, or less, along the horizontal axis 404 may indicate a shut-off curtailment demand response. In this example, the input voltage maps to demand response 406*f*, which corresponds to a power decrease for the compressor, e.g., power to the compressor may be decreased down to 0 kW in order to shut-off or cease operation of the climate control system. In some examples, the demand response 406*f* may cause an at least partially gradual wind down operation for the compressor and/or other components of the climate control system in order to reduce stresses on the climate control system and reduce the likelihood of damage caused by an abrupt shut-off.

It should be understood that the compressor is not the only component of the climate control system that dictates conditioning capacity and as a result the adjusted operating parameter for the compressor may vary based on other factors, e.g., the operating parameter for other components, thermal loads, outdoor ambient temperature or humidity, etc. Thus, in some examples, some or all of the components of the climate control system may be operated at the same, or substantially similar, rated, curtailed, and/or load-up levels. For example, multiple components may be jointly controlled in some examples.

Again, it is understood that the above example is just one approach to mapping a power input value and/or first voltage indication to an adjusted operating parameter of the climate control system 100, or component thereof. For example, other approaches and values may be used. It is further understood that the example above with regard to a DC power compressor is similarly applicable to other components and/or multiple components of the climate control system, operating on DC power or the like.

Indeed, to walk through further examples, reference is made to FIG. 3A and process step 306. As discussed above, the process 300 may determine that the adjusted operating parameter may be set to a load-up setting. This determination may be based on an increased first voltage indication as discussed above, or through other methods. However, in general, the load-up setting with reference to the climate control system may include converting the excess electrical energy provided by the microgrid into some type of thermal energy, mechanical energy, or potentially other forms of energy storage. Further, in some examples, this includes operating and/or running lower efficiency modes, e.g., defrost mode, potentially at off-schedule times, to take advantage of the increase in electrical supply from the microgrid.

To walk through some examples, loading-up the climate control system may include increasing at least an operating parameter of a component to exceed the normal operating level required to meet at least the requested conditioning demand. For example, the climate control system may load-up a conditioned space during heating modes by increasing the temperature of the space above a temperature setpoint defined by a user, typically by only a few degrees. Similarly, the climate control system may load-up in cooling modes by decreasing the temperature of the conditioned space below a temperature setpoint defined by a user. Thus, the user defined operating parameter of the temperature setpoint may be automatically and/or dynamically adjusted to the adjusted operating parameter of the lower or higher temperature setpoint. In some examples, these setpoint limits are capped, e.g., limited to a change of between approximately 1° F. and 4° F., to avoid occupant discomfort. It should be understood, that higher or lower setpoint limits may be utilized.

In some examples, the climate control system may initiate pre-cooling or pre-heating for a conditioned space in response to a load-up and/or advanced load-up demand response in order to utilize excess available power. In some examples, a load-up and/or advanced load-up demand response may cause pre-humidification or pre-dehumidification, e.g., adding excess moisture or removing excess moisture to the air before a user defined setpoint offset is reached. For example, the climate control system may initiate conditioning of a conditioned space in the absence of another indication, e.g., the conditioned space temperature deviated from a setpoint by a setpoint offset. In some examples, a second indication may cause the climate control system to pre-cool or pre-heat a conditioned space in the absence of a load-up, advanced load-up, and/or other demand response. For example, the second indication may be indicative of a scheduled time to pre-condition an unoccupied space before an occupant returns, e.g., from school, work, or the like. Still the second indication may cause pre-conditioning, e.g., pre-humidification, pre-dehumidification, pre-cooling or pre-heating, in response to various other conditions set forth by the present disclosure.

In some examples, the temperature setpoint may include an occupied and an unoccupied setting, each of which may be user defined. The occupied setting may be directed to maximum comfort for individuals within the space, and the unoccupied setting may be directed to limiting energy use while individuals are not within the space, e.g., the unoccupied setting may be a hotter temperature setpoint in cooling mode and a cooler setpoint in heating mode. In some examples, the load-up setting may include adjusting an unoccupied setpoint to an occupied setpoint. This approach may allow thermal energy to be stored within the space, and may potentially limit the energy used once an individual does enter the space. In some examples, motion sensors or the like may be utilized to determine when an occupant enters or exits the conditioned space in order to determine whether to utilize an unoccupied or an occupied setpoint. Other approaches may also be utilized.

Similarly, the load-up setting may adjust the humidity parameters of climate control system 100 to take advantage of instances where higher levels of energy are available. For example, loading-up the climate control system may include adjusting the humidity settings for the unit. This may include operating the climate control system in a dehumidification mode at increased frequency and/or duration. This may also include lowering the target humidity level, or potentially other methods. In some examples, this may include reducing the indoor heat exchanger coil or saturation temperature setting to remove higher levels of moisture from the air while maintaining a consistent sensible temperature level within the space. These examples may assist in lowering the latent load of the conditioned space, again storing the excess electrical energy as thermal energy.

In some examples, the climate control system may include a phase change material, and load-up setting may include storing thermal energy within the phase change material. For example, a phase change material may be coupled to the refrigerant circuit as a supplemental thermal sink and/or source for the refrigerant fluid. For example, the phase change material may be used to defrost the outdoor heat exchanger during cooler conditions. An example implementation of this configuration is discussed in U.S. patent application Ser. No. 17/554,515 entitled "Thermal Storage Device for Climate Control System," and filed on Dec. 17, 2021, which is hereby incorporated in its entirety.

Other phase change materials may also be incorporated in other locations or configurations within the refrigerant circuit to assist with thermal transfer during heating or cooling mode. Still further, thermal reservoirs, which may include phase change materials, may be located and/or associated with the climate control system. For example, a climate control system may include a thermal energy storage system, e.g., an ice tank or the like for storing thermal energy. In some examples, conditioned spaces may include phase change material to assist in maintaining a given thermal level within the conditioned spaces. In these examples, the load-up setting may utilize the excess electrical energy provided by the microgrid to further charge the phase change material and/or thermal energy storage system, storing this electrical energy as thermal energy to be later used by the climate control system as needed. Other forms of load-up settings are also discussed within this disclosure, and this disclosure is not limited to the examples presented herein.

Again, these are example implementations of adjustments that may be made to one or more parameters of the climate control system 100, however, other adjustments may be made in accordance with the disclosure provided herein.

Returning to FIG. 3A, the process 300 may further include powering the at least one component from a power supply provided by the microgrid power unit 102, as shown in step 308. This power may be supplied in a manner consistent with one or more processes and components of the microgrid power unit 102 as described by the present disclosure.

In some examples, the process 300 may further include determining that a switch from one power supply to another power supply is appropriate based on power availability or other conditions of at least the first or second indication. The process 300 may include determining a power availability via a first indication and a future or estimated power availability via at least a second indication for two or more power sources. For example, the climate control system may determine that a switch is required based on the first indication, and may further request a specific power source from the microgrid to meet a conditioning demand based on a second indication. A first power source for example may be solar panels and a second power source may be a utility power grid coupled to the microgrid. The process 300 may decide to use the solar panel to supply power for a time. The time to utilize the solar panels may be determined by the future estimated power availability of the solar panels, for example based on when cloud coverage will reduce the power output by the panels.

The indication of when cloud coverage is expected to affect the solar panels may be provided by one or more sensors of the microgrid or via weather forecast information, e.g., provided from an online source, website, or the like. After the time to utilize the solar panels has elapsed, the process may, in some examples, decide to switch the power supply for the climate control system to the utility power grid. The switch to the utility power grid may be an automatic backup choice or it may be selected as the best of multiple different secondary power sources based on each sources power availability. In some examples, the microgrid may include other power sources such as wind or water turbines that may be similarly monitored for power availability, and the process may select these other power sources to supply the climate control system or other devices coupled to the microgrid. In some examples, the renewable power sources of the microgrid may supply sufficient power to meet electrical demand.

In some examples, the microgrid controller may receive an indication from the utility power grid to use utility power to charge a battery storage unit during periods of low electrical demand on the utility power grid. The microgrid controller may utilize the battery storage unit during periods of high electrical demand on the utility power grid when other power sources are not available. In some examples, the amount of electrical demand on the utility power grid may correlate with costs of utilizing the utility power grid (e.g., high/low electrical demand causes cost per kW to increase/decrease).

Still referring to FIG. 3A, the process 300 may further include operating the at least one component of the climate control system at the adjusted operating parameter, as shown in step 310. In some examples, once the climate control system has determined to operate according to a particular demand response, the system controller may cause one or more components of the climate control system to operate according to settings associated with the particular demand response. In some examples, the particular demand response may be defined by a set of operating instructions interpreted by a controller. For example, the climate control system may determine a demand response based on the first or second indications and based on the demand response determination the system controller may select and load a set of instructions (e.g., a predefined operating mode, from memory, etc.).

Figure 3B:
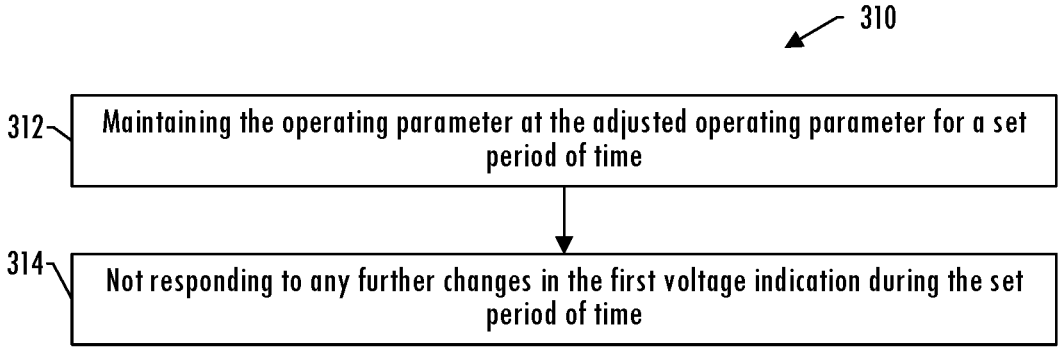

FIG. 3B provides further details of process steps that may be included as part of process 300 discussed above. For example, FIG. 3B shows an example process of step 310 that may be utilized to operate a climate control system (e.g., 100 or the like) with demand responses. As shown in FIG. 3B, the step of operating the component at the adjusted operating parameter, shown in step 310, may further include maintaining the operating parameter at the adjusted operating parameter for a set period of time, as shown in step 312. In some examples, power availability may fluctuate at or near a continuous rate and the climate control system and/or microgrid may determine a set period of time based on a congregate of information associated with these fluctuations. For example, based on large rapid fluctuations a longer time period with a lower adjusted operating parameter may be utilized to overcompensate for unpredictable large drops in power availability. In some examples, a series of adjusted operating parameters may be utilized with shorter time periods, based on slow continuous fluctuations or more predictable changes in power availability. In some examples, the period of time is based on a time for a demand response provided by a local utility.

The process 300 may further include not responding to any further changes in the first voltage indication during the set period of time, as shown in step 314. In some examples, during operation according to a previously selected demand response, voltage or other types of indications may continue to be received. In order, for example to prevent additional wear on components, a climate control system may be configured to ignore such indications during a period of time associated with the previously selected demand response.

In some examples, the climate control system may not change operations based on changes in the first voltage indication during the set period of time, however the climate control system and/or the microgrid may continue to monitor and record any changes in the first voltage indication during the set period of time. For example, when the set period of time has elapsed the climate control system may switch to another operating mode based on any and/or all changes recorded for the first voltage indication, and/or other indications, during the set period of time.

In some examples, the climate control system may request that all indications, for example from the microgrid, cease during the set period of time. In some examples, the microgrid may record any changes during the set period of time and provide at least some indications based on those changes to the climate control system after the set period of time has elapsed. In some examples, the climate control system may block or cutoff at least some communication interfaces. For example, during the set period of time the climate control system may lock a user interface such as via a thermostat or block a communication port associated with the microgrid controller.

In some examples, the first voltage indication, the second indication, and/or similar communications may be sent through a cloud-to-cloud interface, e.g., to cause operation according to a demand response as described by the present disclosure. In some examples, indications may be shared between appliances (e.g., the climate control system, dishwasher, washing machine, or the like) through the cloud-to-cloud interface as well as with the microgrid and/or utility grid. While the climate control system may respond to the first voltage indication and/or the second indication as described above, other appliances may respond with various different demand responses that may be the same as, or similar to, those described above with respect to the climate control system. Any or all of the processes discuss by the present disclosure with respect to climate control systems may also be applied to other appliances.

In some examples, periodical appliances (e.g., dishwashers, clothes washing machines, clothes dryers, etc.) may delay entry into a next phase of operation based on receipt of a demand response signal. For example, a clothes washing machine may be in the middle of a washing cycle when a first voltage indication is received and in response the clothes washing machine may continue to complete the washing cycle but may then pause operation for a time before entering a rinsing cycle. In some examples, the clothes washing machine may pause the current washing cycle at some midpoint due to receipt of an indication. For example, the climate control system may request, e.g., by sending an indication via a communication bus (e.g., communication bus 110, the cloud-to-cloud interface, or the like), that the clothes washing machine pause for a predefined amount of time so that more power may be utilized by the climate control system to meet a conditioning demand. In some examples, a periodical appliance may operate according to a demand response by stepping down operations from a higher power consumption cycle to a lower power consumption cycle. For example, a dishwasher may be set to operate according to a heavy wash cycle (e.g., 135 minute runtime using approximately 165° F. water to wash and rinse) and in response to a curtailment demand response the dishwasher may step-down to operate according to settings for a normal wash cycle (e.g., 90 minute runtime using approximately 150° F. water to wash and 120° F. water to rinse).

In some examples, two or more periodical appliances may communicate bidirectionally, e.g., via the cloud-to-cloud interface or the like, to coordinate and/or alternate high power consumption cycles. For example, a clothes washing machine may pause a washing cycle so that a clothes dryer can run a high heat drying cycle or vice versa. The first paused appliance may then resume operation after the high power consumption cycle of the second appliance is complete. Additionally, the second appliance may pause operations to allow the first appliance to complete its high power consumption cycle. Further, both appliances may resume operations simultaneously when they can both operate in a low power consumption cycle. Furthermore, both appliances may resume operations simultaneously upon receipt of a first voltage indication that sufficient power is available. The periodical appliances may respond to utility grid demand response events and/or utility grid costs as described above with respect to the FIG. 5 illustrates the control circuitry 500, which may be an apparatus, according to some examples of the present disclosure. In some examples, the control circuitry 500 may be configured as one or more of a system controller 150, the other controllers referenced in this disclosure, or any other similar devices described by the present disclosure. In some examples, control circuitry 500 may be configured at least partially as a server or remotely accessible device, e.g., through the Internet, a cloud-to-cloud interface, or the like.

In some examples, the control circuitry may include one or more of each of a number of components such as, for example, a processor 502 connected to a memory 504. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 502 may be a number of processors, a multi-core processor or some other type of processor, depending on the particular example.

The processor 502 may be configured to execute computer programs such as computer-readable program code 506, which may be stored onboard the processor or otherwise stored in the memory 504. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 504 is generally any piece of computer hardware capable of storing information such as, for example, data, computer-readable program code 506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 502, causes the control circuitry 500 to perform various operations as described herein, some of which may in turn cause the HVAC system to perform various operations.

In addition to the memory 504, the processor 502 may also be connected to one or more peripherals such as a network adapter 508, one or more input/output (I/O) devices (e.g., input device(s) 510, output device(s) 512) or the like. The network adapter is a hardware component configured to connect the control circuitry 500 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A climate control system coupled to a microgrid power unit and configured to provide a stepped demand response, the climate control system comprising: a plurality of components, wherein at least one component is powered from a power supply provided by the microgrid power unit; and a controller operably coupled to the at least one component, the controller including a memory configured to store computer executable components and a processor configured to execute computer executable components to cause the controller to at least: receive a first voltage indication from the microgrid power unit, the microgrid power unit including a renewable power source; determine a second indication, the second indication indicative of a condition of at least one of the following the climate control system, the microgrid power unit, and a utility power grid; determine an adjusted operating parameter for the at least one component of the climate control system based on the first voltage indication and the second indication, wherein determining the adjusted operating parameter for the at least one component includes adjusting an operating parameter to the adjusted operating parameter based on a stepped adjustment in response to a linear change or a non-discrete change in the first voltage indication; and operate the at least one component of the climate control system at the adjusted operating parameter.

Clause 2. The climate control system in any of the clauses, wherein operating the at least one component includes maintaining the adjusted operating parameter for a set period of time and not responding to any further changes in the first voltage indication during the set period of time.

Clause 3. The climate control system in any of the clauses, wherein the power supply provided by the microgrid power unit is configured to both power the at least one component and carry the first voltage indication, and wherein the power supply provided by the microgrid power unit is further configured to carry the second indication to be interpreted by the climate control system.

Clause 4. The climate control system in any of the clauses, wherein the adjusted operating parameter corresponds to a plurality of operating levels, the plurality of operating levels including a shut-off level, a 40% level, a 70% level, a 100% level, and a load-up level, and wherein determining the adjusted operating parameter includes selecting an operating level from the plurality of operating levels based on the first voltage indication.

Clause 5. The climate control system in any of the clauses, wherein the at least one component is a direct current (DC) powered compressor with a rated operating voltage of 350V, and wherein determining the adjusted operating parameter includes operating the DC powered compressor at: the 100% level when the first voltage indication is between 340V and 360V; the 70% level when the first voltage indication is between 330V and 340V; the 40% level when the first voltage indication is between 325V and 330V; the shut-off level when the first voltage indication is less than 325V; and the load-up level when the first voltage indication is between 360V and 380V.

Clause 6. The climate control system in any of the clauses, wherein the climate control system is connected to both the microgrid power unit and the utility power grid, the utility power grid being an independent power network from the microgrid power unit, wherein the utility power grid provides an additional power source to the at least one component of the climate control system, the additional power source configured to both provide the power supply for the at least one component and carry one or more indications to be interpreted by the climate control system, the one or more indications including the second indication.

Clause 7. The climate control system in any of the clauses, wherein the second indication is a second voltage indication indicative of a demand response event by a utility power grid, the utility power grid being an independent power network from the microgrid power unit, and wherein determining the adjusted operating parameter includes confirming the utility power grid has issued a demand response event Clause 8. The climate control system in any of the clauses, wherein determining the adjusted operating parameter for the at least one component of the climate control system includes adjusting a user defined setpoint for the climate control system, the user defined setpoint being a temperature setpoint, and adjusting the user defined setpoint includes changing from an unoccupied temperature setpoint to an occupied temperature setpoint; wherein determining the adjusted operating parameter for the at least one component of the climate control system includes adjusting a user defined setpoint offset for the climate control system, the user defined setpoint offset being a temperature value above or below the temperature setpoint; wherein adjusting the user defined setpoint includes changing from an unoccupied temperature setpoint to an occupied temperature setpoint when operating the DC powered compressor at a load-up level; and wherein adjusting the user defined setpoint includes changing from an occupied temperature setpoint to an unoccupied temperature setpoint when operating the DC powered compressor at a curtailment level less than a 100% level.

Clause 9. The climate control system in any of the clauses, wherein determining the adjusted operating parameter for the at least one component of the climate control system includes selecting a dehumidification mode for the climate control system.

Clause 10. The climate control system in any of the clauses, wherein determining the adjusted operating parameter for the at least one component of the climate control system includes adjusting a saturation temperature setting for a heat exchanger of the climate control system.

Clause 11. The climate control system in any of the clauses, wherein the climate control system is connected to both the microgrid power unit and a utility power grid, the utility power grid being an independent power network from the microgrid power unit, wherein the operating parameter includes selecting a power supply for the at least one component to be either the microgrid power unit or the utility power grid, wherein selection of the microgrid power unit further includes selecting between a battery storage unit and at least the renewable power source, the battery storage unit being one or more of a chemical battery or a mechanical battery, wherein the selecting between the battery storage unit and at least the renewable power source is determined based on available power from each power source for a period of time, and wherein the utility power grid is selected based on a determination that the battery storage unit and at least the renewable power source are insufficient to meet a power demand for the period of time.

Clause 12. The climate control system in any of the clauses, wherein the microgrid power unit further includes a battery storage unit, and the second indication is an indication of a charge level for the battery storage unit.

Clause 13. The climate control system in any of the clauses, wherein the second indication is indicative of an environmental condition, the environmental condition being one of at least an ambient outdoor air temperature and an ambient outdoor air humidity level.

Clause 14. The climate control system in any of the clauses, wherein determining the adjusted operating parameter for the at least one component of the climate control system includes selecting a defrost mode for the climate control system.

Clause 15. The climate control system in any of the clauses, wherein determining the adjusted operating parameter for the at least one component of the climate control system includes adjusting a coil temperature setting a heat exchanger of the climate control system.

Clause 16. The climate control system in any of the clauses, wherein the climate control system further includes a phase change material, and wherein determining the adjusted operating parameter for the at least one component of the climate control system includes entering a charge mode for the phase change material, wherein the charge mode of the climate control system includes a load-up setting to further charge one or more of the phase change material and a thermal energy storage system.

Clause 17. The climate control system in any of the clauses, wherein the renewable power source includes one or more of a photovoltaic cell, solar panel, wind turbine, biomass boiler, tidal stream generator, wave energy converter, geothermal power plant, or water turbine.

Clause 18. The climate control system in any of the clauses, wherein a user provides an override indication to prevent operating the at least one component of the climate control system at the adjusted operating parameter, wherein the override indication causes the climate control system to prioritize maintaining a user defined setpoint, and wherein the user defined setpoint is one or more of a temperature setpoint, a humidity setpoint, or a fan setpoint.

Clause 19. The climate control system in any of the clauses, wherein the override indication is representative of a user preference to opt-out of utilizing a stepped down demand response; wherein the override indication is determined based, at least in part, on a user defined setpoint offset being exceeded; and wherein the user defined setpoint offset defines a range of values above or below the user defined setpoint; and wherein the user defined setpoint offset is one or more of +4° F. for temperature of +5% for relative humidity.

Clause 20. The climate control system in any of the clauses, wherein a user provides an override indication to cease operating the at least one component of the climate control system at the adjusted operating parameter; wherein the override indication is automatically generated based, at least in part, on a predefined safety threshold value; wherein the safety threshold value is 95° F. in cooling mode and causes the override indication to be automatically generated when a temperature of the conditioned spaces is equal to or greater than 95° F. in cooling mode; and wherein the safety threshold value is 47° F. in heating mode and causes the override indication to be automatically generated when a temperature of the conditioned spaces is equal to or less than 47° F. in heating mode; and wherein the user provides an indication representative of an adjustment to increase or decrease one or more safety threshold values.

Clause 21. A method of controlling a climate control system coupled to a microgrid power unit and configured to provide a stepped demand response, the climate control system including a controller and a plurality of components, at least one component of the plurality of components operably controllable by the controller, the method comprising: receiving a first voltage indication from the microgrid power unit, the microgrid power unit including a renewable power source; determining a second indication, the second indication indicative of a condition of at least one of the following the climate control system, the microgrid power unit, and a utility power grid; determining an adjusted operating parameter for the at least one component of the climate control system based on the first voltage indication and the second indication, wherein determining the adjusted operating parameter for the at least one component includes adjusting the operating parameter to an adjusted operating parameter based on a stepped adjustment in response to a linear change or a non-discrete change in the first voltage indication; powering the at least one component from a power supply provided by the microgrid power unit; and operating the at least one component of the climate control system at the adjusted operating parameter.

Clause 22. The method in any of the clauses, wherein operating the at least one component includes maintaining the adjusted operating parameter for a set period of time and not responding to any further changes in the first voltage indication during the set period of time.

Clause 23. The method in any of the clauses, wherein receiving the first voltage indication further includes receiving the first voltage indication from the power supply provided by the microgrid power unit.

Clause 24. The method in any of the clauses, wherein the adjusted operating parameter corresponds to a plurality of operating levels, the plurality of operating levels including a shut-off level, a 40% level, a 70% level, a 100% level, and load-up level, and wherein determining the adjusted operating parameter includes selecting an operating level from the plurality of operating levels based on the first voltage indication.

Clause 25. The method in any of the clauses, wherein the at least one component is a direct current (DC) powered compressor with a rated operating voltage of 350V, and wherein determining the adjusted operating parameter includes operating the DC powered compressor at: the 100% level when the first voltage indication is between 340V and 360V; the 70% level when the first voltage indication is between 330V and 340V; the 40% level when the first voltage indication is between 325V and 330V; the shut-off level when the first voltage indication is less than 325V; and the load-up level when the first voltage indication is between 360V and 380V.

Clause 26. The method in any of the clauses, wherein the climate control system is connected to both the microgrid power unit and the utility power grid, the utility power grid being an independent power network from the microgrid power unit, wherein receiving the second indication includes receiving the second indication from an additional power source provided by the utility power grid, and wherein powering the at least one component includes powering the at least one component from the additional power source provided by the utility power grid.

Clause 27. The method in any of the clauses, wherein the second indication is a second voltage indication indicative of a demand response event by a utility power grid, the utility power grid being an independent power network from the microgrid power unit, and wherein determining the adjusted operating parameter includes confirming the utility power grid has issued a demand response event.

Clause 28. The method in any of the clauses, wherein determining the adjusted operating parameter for the at least one component of the climate control system includes adjusting a user defined setpoint for the climate control system, the user defined setpoint being a temperature setpoint, and adjusting the user defined setpoint includes changing from an unoccupied temperature setpoint to an occupied temperature setpoint; and wherein determining the adjusted operating parameter for the at least one component of the climate control system includes adjusting a user defined setpoint offset for the climate control system, the user defined setpoint offset being a temperature value above or below the temperature setpoint; wherein adjusting the user defined setpoint includes changing from an unoccupied temperature setpoint to an occupied temperature setpoint when operating the DC powered compressor at a load-up level; and wherein adjusting the user defined setpoint includes changing from an occupied temperature setpoint to an unoccupied temperature setpoint when operating the DC powered compressor at a curtailment level less than a 100% level.

Clause 29. The method in any of the clauses, wherein determining the adjusted operating parameter for the at least one component of the climate control system includes selecting a dehumidification mode for the climate control system.

Clause 30. The method in any of the clauses, wherein determining the adjusted operating parameter for the at least one component of the climate control system includes adjusting a saturation temperature setting for a heat exchanger of the climate control system.

Clause 31. The method in any of the clauses, wherein the climate control system is connected to both the microgrid power unit and a utility power grid, the utility power grid being an independent power network from the microgrid power unit, wherein the operating parameter includes selecting a power supply for the at least one component to be either the microgrid power unit or the utility power grid, wherein selection of the microgrid power unit further includes selecting between a battery storage unit and at least the renewable power source, the battery storage unit being one or more of a chemical battery or a mechanical battery, wherein the selecting between the battery storage unit and at least the renewable power source is determined based on available power from each power source for a period of time, and wherein the utility power grid is selected based on a determination that the battery storage unit and at least the renewable power source are insufficient to meet a power demand for the period of time.

Clause 32. The method in any of the clauses, wherein the microgrid power unit further includes a battery storage unit, and the second indication is an indication of a charge level for the battery storage unit.

Clause 33. The method in any of the clauses, wherein the second indication is indicative of an environmental condition, the environmental condition being one of at least an ambient outdoor air temperature and an ambient outdoor air humidity level.

Clause 34. The method in any of the clauses, wherein determining the adjusted operating parameter for the at least one component of the climate control system includes selecting a defrost mode for the climate control system.

Clause 35. The method in any of the clauses, wherein determining the adjusted operating parameter for the at least one component of the climate control system includes adjusting a coil temperature setting a heat exchanger of the climate control system.

Clause 36. The method in any of the clauses, wherein the climate control system further includes a phase change material, and wherein determining the adjusted operating parameter for the at least one component of the climate control system includes entering a charge mode for the phase change material, wherein the charge mode of the climate control system includes a load-up setting to further charge one or more of the phase change material and a thermal energy storage system.

Clause 37. The method in any of the clauses, wherein the renewable power source includes one or more of a photovoltaic cell, solar panel, wind turbine, biomass boiler, tidal stream generator, wave energy converter, geothermal power plant, or water turbine.

Clause 38. The method in any of the clauses, wherein a user provides an override indication to prevent operating the at least one component of the climate control system at the adjusted operating parameter, wherein the override indication causes the climate control system to prioritize maintaining a user defined setpoint, and wherein the user defined setpoint is one or more of a temperature setpoint, a humidity setpoint, or a fan setpoint.

Clause 39. The method in any of the clauses, wherein the override indication is representative of a user preference to opt-out of utilizing a stepped down demand response; wherein the override indication is determined based, at least in part, on a user defined setpoint offset being exceeded; and wherein the user defined setpoint offset defines a range of values above or below the user defined setpoint; and wherein the user defined setpoint offset is one or more of +4° F. for temperature of +5% for relative humidity.

Clause 40. The method in any of the clauses, wherein a user provides an override indication to cease operating the at least one component of the climate control system at the adjusted operating parameter; wherein the override indication is automatically generated based, at least in part, on a predefined safety threshold value; wherein the safety threshold value is 95° F. in cooling mode and causes the override indication to be automatically generated when a temperature of the conditioned spaces is equal to or greater than 95° F. in cooling mode; and wherein the safety threshold value is 47° F. in heating mode and causes the override indication to be automatically generated when a temperature of the conditioned spaces is equal to or less than 47° F. in heating mode; and wherein the user provides an indication representative of an adjustment to increase or decrease one or more safety threshold values.

Clause 41. A microgrid system comprising: a microgrid power unit including a renewable power source and a battery storage unit; a climate control system including an outdoor unit including a compressor and an outdoor heat exchanger, an indoor unit including a fan and an indoor heat exchanger, a refrigerant circuit configured to couple at least the outdoor unit and the indoor unit; and an electrical circuit configured to couple two or more components of the microgrid system, the electrical circuit including a controller including a memory configured to store computer executable components and a processor configured to execute computer executable components to cause the controller to at least: receive a first voltage indication from the microgrid power unit, the microgrid power unit including a renewable power source; determine a second indication, the second indication indicative of a condition of at least one of the following the climate control system, the microgrid power unit, and a utility power grid; determine an adjusted operating parameter for the at least one component of the climate control system based on the first voltage indication and the second indication, wherein determining the adjusted operating parameter for the at least one component includes adjusting an operating parameter to the adjusted operating parameter based on a stepped adjustment in response to a linear change or a non-discrete change in the first voltage indication; and operate the at least one component of the climate control system at the adjusted operating parameter.

Clause 42. The microgrid system in any of the clauses, wherein operating the at least one component includes maintaining the adjusted operating parameter for a set period of time and not responding to any further changes in the first voltage indication during the set period of time.

Clause 43. The microgrid system in any of the clauses, wherein a power supply provided by the microgrid power unit is configured to both power the at least one component and carry the first voltage indication, and wherein the power supply provided by the microgrid power unit is further configured to carry the second indication to be interpreted by the climate control system.

Clause 44. The microgrid system in any of the clauses, wherein the adjusted operating parameter corresponds to a plurality of operating levels, the plurality of operating levels including a shut-off level, a 40% level, a 70% level, a 100% level, and a load-up level, and wherein determining the adjusted operating parameter includes selecting an operating level from the plurality of operating levels based on the first voltage indication.

Clause 45. The microgrid system in any of the clauses, wherein the at least one component is a direct current (DC) powered compressor with a rated operating voltage of 350V, and wherein determining the adjusted operating parameter includes operating the DC powered compressor at: the 100% level when the first voltage indication is between 340V and 360V; the 70% level when the first voltage indication is between 330V and 340V; the 40% level when the first voltage indication is between 325V and 330V; the shut-off level when the first voltage indication is less than 325V; and the load-up level when the first voltage indication is between 360V and 380V.

Clause 46. The microgrid system in any of the clauses, wherein the climate control system is connected to both the microgrid power unit and the utility power grid, the utility power grid being an independent power network from the microgrid power unit, wherein the utility power grid provides an additional power source to the at least one component of the climate control system, the additional power source configured to both provide a power supply for the at least one component and carry one or more indications to be interpreted by the climate control system, the one or more indications including the second indication.

Clause 47. The microgrid system in any of the clauses, wherein the second indication is a second voltage indication indicative of a demand response event by a utility power grid, the utility power grid being an independent power network from the microgrid power unit, and wherein determining the adjusted operating parameter includes confirming the utility power grid has issued a demand response event Clause 48. The microgrid system in any of the clauses, wherein determining the adjusted operating parameter for the at least one component of the climate control system includes adjusting a user defined setpoint for the climate control system, the user defined setpoint being a temperature setpoint, and adjusting the user defined setpoint includes changing from an unoccupied temperature setpoint to an occupied temperature setpoint; and wherein determining the adjusted operating parameter for the at least one component of the climate control system includes adjusting a user defined setpoint offset for the climate control system, the user defined setpoint offset being a temperature value above or below the temperature setpoint; wherein adjusting the user defined setpoint includes changing from an unoccupied temperature setpoint to an occupied temperature setpoint when operating the DC powered compressor at a load-up level; and wherein adjusting the user defined setpoint includes changing from an occupied temperature setpoint to an unoccupied temperature setpoint when operating the DC powered compressor at a curtailment level less than a 100% level.

Clause 49. The microgrid system in any of the clauses, wherein determining the adjusted operating parameter for the at least one component of the climate control system includes selecting a dehumidification mode for the climate control system.

Clause 50. The microgrid system in any of the clauses, wherein determining the adjusted operating parameter for the at least one component of the climate control system includes adjusting a saturation temperature setting for a heat exchanger of the climate control system.

Clause 51. The microgrid system in any of the clauses, wherein the climate control system is connected to both the microgrid power unit and a utility power grid, the utility power grid being an independent power network from the microgrid power unit, wherein the operating parameter includes selecting a power supply for the at least one component to be either the microgrid power unit or the utility power grid, wherein selection of the microgrid power unit further includes selecting between a battery storage unit and at least the renewable power source, the battery storage unit being one or more of a chemical battery or a mechanical battery, wherein the selecting between the battery storage unit and at least the renewable power source is determined based on available power from each power source for a period of time, and wherein the utility power grid is selected based on a determination that the battery storage unit and at least the renewable power source are insufficient to meet a power demand for the period of time.

Clause 52. The microgrid system in any of the clauses, wherein the microgrid power unit further includes a battery storage unit, and the second indication is an indication of a charge level for the battery storage unit.

Clause 53. The microgrid system in any of the clauses, wherein the second indication is indicative of an environmental condition, the environmental condition being one of at least an ambient outdoor air temperature and an ambient outdoor air humidity level.

Clause 54. The microgrid system in any of the clauses, wherein determining the adjusted operating parameter for the at least one component of the climate control system includes selecting a defrost mode for the climate control system.

Clause 55. The microgrid system in any of the clauses, wherein determining the adjusted operating parameter for the at least one component of the climate control system includes adjusting a coil temperature setting a heat exchanger of the climate control system.

Clause 56. The microgrid system in any of the clauses, wherein the climate control system further includes a phase change material, and wherein determining the adjusted operating parameter for the at least one component of the climate control system includes entering a charge mode for the phase change material, wherein the charge mode of the climate control system includes a load-up setting to further charge one or more of the phase change material and a thermal energy storage system.

Clause 57. The microgrid system in any of the clauses, wherein the renewable power source includes one or more of a photovoltaic cell, solar panel, wind turbine, biomass boiler, tidal stream generator, wave energy converter, geothermal power plant, or water turbine.

Clause 58. The microgrid system in any of the clauses, wherein a user provides an override indication to prevent operating the at least one component of the climate control system at the adjusted operating parameter, wherein the override indication causes the climate control system to prioritize maintaining a user defined setpoint, and wherein the user defined setpoint is one or more of a temperature setpoint, a humidity setpoint, or a fan setpoint.

Clause 59. The microgrid system in any of the clauses, wherein the override indication is representative of a user preference to opt-out of utilizing a stepped down demand response; wherein the override indication is determined based, at least in part, on a user defined setpoint offset being exceeded; and wherein the user defined setpoint offset defines a range of values above or below the user defined setpoint; and wherein the user defined setpoint offset is one or more of +4° F. for temperature or +5% for relative humidity.

Clause 60. The microgrid system in any of the clauses, wherein a user provides an override indication to cease operating the at least one component of the climate control system at the adjusted operating parameter; wherein the override indication is automatically generated based, at least in part, on a predefined safety threshold value; wherein the safety threshold value is 95° F. in cooling mode and causes the override indication to be automatically generated when a temperature of the conditioned spaces is equal to or greater than 95° F. in cooling mode; and wherein the safety threshold value is 47° F. in heating mode and causes the override indication to be automatically generated when a temperature of the conditioned spaces is equal to or less than 47° F. in heating mode; and wherein the user provides an indication representative of an adjustment to increase or decrease one or more safety threshold values.

Many modifications, other embodiments, examples, or implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments, examples, or implementations disclosed and that modifications and other embodiments, examples, or implementations are intended to be included within the scope of the appended claims. Moreover, although the foregoing description and the associated figures describe embodiments, examples, or implementations in the context of certain example combinations of elements and/or functions, it should be appreciated that different combinations of elements and/or functions may be provided by alternative embodiments, examples, or implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A climate control system coupled to a microgrid power unit and configured to provide a stepped demand response, the climate control system comprising:

a plurality of components, wherein at least one component is powered from a power supply provided by the microgrid power unit; and a controller operably coupled to the at least one component, the controller including a memory configured to store computer executable components and a processor configured to execute computer executable components to cause the controller to at least:

receive a first voltage indication from the microgrid power unit, the microgrid power unit including a renewable power source;

determine a second indication, the second indication indicative of a condition of at least one of the following the climate control system, the microgrid power unit, and a utility power grid;

determine an adjusted operating parameter for the at least one component of the climate control system based on the first voltage indication and the second indication, wherein determining the adjusted operating parameter for the at least one component includes adjusting an operating parameter to the adjusted operating parameter based on a stepped adjustment in response to a linear change or a non-discrete change in the first voltage indication; and operate the at least one component of the climate control system at the adjusted operating parameter.

2. The climate control system of claim 1, wherein operating the at least one component includes maintaining the adjusted operating parameter for a set period of time and not responding to any further changes in the first voltage indication during the set period of time.

3. The climate control system of claim 1, wherein the power supply provided by the microgrid power unit is configured to both power the at least one component and carry the first voltage indication, and wherein the power supply provided by the microgrid power unit is further configured to carry the second indication to be interpreted by the climate control system.

4. The climate control system of claim 1, wherein the adjusted operating parameter corresponds to a plurality of operating levels, the plurality of operating levels including a shut-off level, a 40% level, a 70% level, a 100% level, and a load-up level, and wherein determining the adjusted operating parameter includes selecting an operating level from the plurality of operating levels based on the first voltage indication.

5. The climate control system of claim 4, wherein the at least one component is a direct current (DC) powered compressor with a rated operating voltage of 350V, and wherein determining the adjusted operating parameter includes operating the DC powered compressor at:

the 100% level when the first voltage indication is between 340V and 360V;

the 70% level when the first voltage indication is between 330V and 340V;

the 40% level when the first voltage indication is between 325V and 330V;

the shut-off level when the first voltage indication is less than 325V; and the load-up level when the first voltage indication is between 360V and 380V.

6. The climate control system of claim 1, wherein the climate control system is connected to both the microgrid power unit and the utility power grid, the utility power grid being an independent power network from the microgrid power unit, wherein the utility power grid provides an additional power source to the at least one component of the climate control system, the additional power source configured to both provide the power supply for the at least one component and carry one or more indications to be interpreted by the climate control system, the one or more indications including the second indication.

7. The climate control system of claim 1, wherein the second indication is a second voltage indication indicative of a demand response event by a utility power grid, the utility power grid being an independent power network from the microgrid power unit, and wherein determining the adjusted operating parameter includes confirming the utility power grid has issued a demand response event.

8. The climate control system of claim 1, wherein determining the adjusted operating parameter for the at least one component of the climate control system includes adjusting a user defined setpoint for the climate control system, the user defined setpoint being a temperature setpoint, and adjusting the user defined setpoint includes changing from an unoccupied temperature setpoint to an occupied temperature setpoint; and wherein determining the adjusted operating parameter for the at least one component of the climate control system includes adjusting a user defined setpoint offset for the climate control system, the user defined setpoint offset being a temperature value above or below the temperature setpoint.

9. The climate control system of claim 8, wherein adjusting the user defined setpoint includes changing from an unoccupied temperature setpoint to an occupied temperature setpoint when operating a DC powered compressor at a load-up level, and wherein adjusting the user defined setpoint includes changing from an occupied temperature setpoint to an unoccupied temperature setpoint when operating the DC powered compressor at a curtailment level less than a 100% level.

10. The climate control system of claim 1, wherein determining the adjusted operating parameter for the at least one component of the climate control system includes selecting a dehumidification mode for the climate control system.

11. The climate control system of claim 1, wherein determining the adjusted operating parameter for the at least one component of the climate control system includes adjusting a saturation temperature setting for a heat exchanger of the climate control system.

12. A method of controlling a climate control system coupled to a microgrid power unit and configured to provide a stepped demand response, the climate control system including a controller and a plurality of components, at least one component of the plurality of components operably controllable by the controller, the method comprising:

receiving a first voltage indication from the microgrid power unit, the microgrid power unit including a renewable power source;

determining a second indication, the second indication indicative of a condition of at least one of the following the climate control system, the microgrid power unit, and a utility power grid;

determining an adjusted operating parameter for the at least one component of the climate control system based on the first voltage indication and the second indication, wherein determining the adjusted operating parameter for the at least one component includes adjusting the operating parameter to an adjusted operating parameter based on a stepped adjustment in response to a linear change or a non-discrete change in the first voltage indication;

powering the at least one component from a power supply provided by the microgrid power unit; and operating the at least one component of the climate control system at the adjusted operating parameter.

13. The method of claim 12, wherein operating the at least one component includes maintaining the adjusted operating parameter for a set period of time and not responding to any further changes in the first voltage indication during the set period of time.

14. The method of claim 12, wherein receiving the first voltage indication further includes receiving the first voltage indication from the power supply provided by the microgrid power unit.

15. The method of claim 12, wherein the adjusted operating parameter corresponds to a plurality of operating levels, the plurality of operating levels including a shut-off level, a 40% level, a 70% level, a 100% level, and load-up level, and wherein determining the adjusted operating parameter includes selecting an operating level from the plurality of operating levels based on the first voltage indication.

16. The method of claim 15, wherein the at least one component is a direct current (DC) powered compressor with a rated operating voltage of 350V, and wherein determining the adjusted operating parameter includes operating the DC powered compressor at:

the 100% level when the first voltage indication is between 340V and 360V;

the 70% level when the first voltage indication is between 330V and 340V;

the 40% level when the first voltage indication is between 325V and 330V;

the shut-off level when the first voltage indication is less than 325V; and the load-up level when the first voltage indication is between 360V and 380V.

17. The method of claim 12, wherein the climate control system is connected to both the microgrid power unit and the utility power grid, the utility power grid being an independent power network from the microgrid power unit, wherein receiving the second indication includes receiving the second indication from an additional power source provided by the utility power grid, and wherein powering the at least one component includes powering the at least one component from the additional power source provided by the utility power grid.

18. The method of claim 12, wherein the second indication is a second voltage indication indicative of a demand response event by a utility power grid, the utility power grid being an independent power network from the microgrid power unit, and wherein determining the adjusted operating parameter includes confirming the utility power grid has issued a demand response event.

19. The method of claim 12, wherein determining the adjusted operating parameter for the at least one component of the climate control system includes adjusting a user defined setpoint for the climate control system, the user defined setpoint being a temperature setpoint, and adjusting the user defined setpoint includes changing from an unoccupied temperature setpoint to an occupied temperature setpoint; and wherein determining the adjusted operating parameter for the at least one component of the climate control system includes adjusting a user defined setpoint offset for the climate control system, the user defined setpoint offset being a temperature value above or below the temperature setpoint.

20. The method of claim 19, wherein adjusting the user defined setpoint includes changing from an unoccupied temperature setpoint to an occupied temperature setpoint when operating a DC powered compressor at a load-up level, and wherein adjusting the user defined setpoint includes changing from an occupied temperature setpoint to an unoccupied temperature setpoint when operating the DC powered compressor at a curtailment level less than a 100% level.

* * * * *